US007886410B2

(12) United States Patent
Yip

(10) Patent No.: US 7,886,410 B2
(45) Date of Patent: Feb. 15, 2011

(54) REVERSIBLE DOOR HINGE

(76) Inventor: Johnnie Yip, 9630 E. Garvey Ave., Rosemead, CA (US) 91170

( * ) Notice: Subject to any disclaimer, the term of this patent is extended or adjusted under 35 U.S.C. 154(b) by 0 days.

(21) Appl. No.: 12/576,442

(22) Filed: Oct. 9, 2009

(65) Prior Publication Data

US 2010/0269301 A1 Oct. 28, 2010

Related U.S. Application Data

(63) Continuation-in-part of application No. 12/455,931, filed on Jun. 9, 2009, which is a continuation-in-part of application No. 12/386,862, filed on Apr. 24, 2009.

(51) Int. Cl.
*E05D 3/10* (2006.01)

(52) U.S. Cl. ..... 16/374; 16/367; 16/239; 16/246; 16/366; 296/146.11

(58) Field of Classification Search ..... 16/374, 16/367, 242, 235–239, 241, 246, 248, 105, 16/54, 50, 286, DIG. 23, 287; 296/146.11, 296/146.12, 76, 96, 146.8; 49/420, 425
See application file for complete search history.

(56) References Cited

U.S. PATENT DOCUMENTS

| | | | | |
|---|---|---|---|---|
| 6,382,327 | B1 * | 5/2002 | Mosdal | 172/311 |
| 6,676,193 | B1 * | 1/2004 | Hanagan | 296/146.11 |
| 6,808,223 | B1 * | 10/2004 | Baum et al. | 296/146.12 |
| 6,820,918 | B1 * | 11/2004 | DeBono | 296/146.11 |
| 7,669,288 | B2 * | 3/2010 | Zeilbeck et al. | 16/354 |
| 2003/0213102 | A1 * | 11/2003 | Ham | 16/374 |
| 2004/0244144 | A1 * | 12/2004 | Ham | 16/221 |
| 2005/0204511 | A1 * | 9/2005 | Wohlfarth | 16/367 |
| 2005/0283948 | A1 * | 12/2005 | Hyde | 16/361 |
| 2006/0096062 | A1 * | 5/2006 | Woolcock | 16/238 |
| 2006/0123592 | A1 * | 6/2006 | Yip | 16/241 |
| 2007/0228763 | A1 * | 10/2007 | Duffy | 296/76 |
| 2008/0083089 | A1 * | 4/2008 | Hoffman | 16/367 |
| 2008/0083090 | A1 * | 4/2008 | Hoffman | 16/367 |
| 2009/0056074 | A1 * | 3/2009 | Chase | 16/321 |

FOREIGN PATENT DOCUMENTS

| | | | |
|---|---|---|---|
| DE | 10059706 | A1 * | 5/2001 |
| DE | 102005039028 | * | 9/2006 |
| EP | 1094184 | A1 * | 4/2001 |

* cited by examiner

*Primary Examiner*—Chuck Y. Mah
(74) *Attorney, Agent, or Firm*—Clement Cheng

(57) ABSTRACT

A vertically opening vehicle door hinge has a base member secured to a chassis at bolt slots disposed as elongated openings on the base member. A primary swivel member is swivel mounted to the base member so that the primary swivel member swivels on the plane defined by the base member. The primary swivel member has a primary swivel axis normal to the point defined by the base member. The arm is swivel mounted to the primary swivel member at a secondary swivel. The secondary swivel has a secondary swivel axis of rotation normal to the primary swivel axis. A motor actuates the primary swivel member. The arm has an extended position corresponding to an open vehicle door and a retracted position corresponding to a closed vehicle door.

20 Claims, 18 Drawing Sheets

REVERSIBLE DOOR HINGE

This application is a continuation in part of application Ser. No. 12/455,931 entitled front door hinge filed Jun. 9, 2009 by inventor Yip, which is a continuation in part of Ser. No. 12/386,862 for Door Hinge filed Apr. 24, 2009 by same inventor Yip.

FIELD OF THE INVENTION

The invention relates to powered door hinges for vehicles.

DISCUSSION OF RELATED ART

A variety of vertically opening car door hinges have been made in the prior art. Unfortunately, the vertically opening car door hinge has a more complicated opening structure, and therefore it has been difficult in the past to provide a commercially responsive and lightweight structure for retrofitting with existing car doors of standard factory model vehicles. Vertically opening car door hinges have the advantage of less space used.

Previous attempts at car door hinges have been overly bulky, and accordingly weight requirements have limited the installation of the hinges. For example, Front Door Car Hinge by Yip, filed as U.S. patent application Ser. No. 11/014,022 filed Dec. 15, 2004 provides for a large base bracket connected to a second large door bracket, the disclosure of which is incorporated herein by reference. Other mechanisms, such as described by Baum in United States patent entitled Two Way Hinge For Motor Vehicle Doors U.S. Pat. No. 6,808,223 issued Oct. 26, 2004, the disclosure of which is incorporated herein by reference, suggests a similarly large and bulky construct. Both Yip Ser. No. 11/014,022 and Baum U.S. Pat. No. 6,808,223 require a large amount of space and have awkward joint construction. Few door hinges today are powered or motorized.

Typically, automobile enthusiasts who enjoy customizing vehicles, also optimize vehicles for lower weight. Thus, it is an object of the invention to provide a space and weight optimized mechanical configuration to facilitate aftermarket retrofit door hinge automotive services. It is also an object of the invention to provide a powered door hinge.

SUMMARY OF THE INVENTION

The door hinge is comprised of a base member, upon which a primary swivel member is mounted. The primary swivel has a shock protrusion receiving a shock bracket, which has a first face parallel to the shock protrusion and a second face facing the shock. The shock has an outer cylinder and a piston in telescopic connection to the outer cylinder. The outer cylinder is connected to a banjo receiver. The banjo receiver is in threaded connection and intimate connection with a base member bolt. The base member bolt has an external threading which preferably threads with an inside surface of the banjo receiver.

A motorized assembly consisting of a motor, a motor gear, a drive gear and a gear formed on the primary swivel member provides a driving force for raising the door.

The door hinge base member has a pair of lower bolt slots and a middle bolt opening and a pair of upper bolt openings. The bolt openings and bolt slots are sized for standard automobile door hinge securing. The standard automobile door hinge can be replaced with the present embodiment door hinge.

A stopper bracket is formed on the base member and has a vertical face facing a stopper bolt. The stopper bracket is preferably formed as a U-shaped member with a flat face facing the stopper bolt.

The shock pushes the arm into an extended position corresponding to the opening of a car door. The arm is attached to the primary swivel member at a secondary swivel. The secondary swivel swivels outward to allow a car door mounted to the end of arm to open outwardly. The swivel axis is on the swivel axle passing through the swivel member and the base member. The secondary swivel passes first through the arm at a first connection finger, then the primary swivel member, before attaching began to the arm at a second connection finger.

The secondary swivel is limited in outward opening angle by a stopper finger which opposes a stopper on primary swivel. Preferably, the secondary swivel has an axle for rotation which passes through stopper finger as well as first connection finger and second connection finger.

A set screw may be threaded and secured into the stopper finger to provide an extension or retraction for adjustment of the maximum outward opening angle. Extension of set screw decreases the maximum outward opening angle and retraction of set screw increases the maximum outward opening angle. The maximum outward opening angle is sized according to a car door dimension. The set screw may have a means for adjusting, such as a Phillips or hexagonal drive surface.

The arm has a pair of branch members including a lower branch member and an upper branch member. The lower branch member is secured to a lower door plate and the upper branch member is secured to an upper door plate. The lower door plate and the upper door plate have bolt opening slots receiving bolts securing to a car door.

The upper branch member and the lower branch member are preferably made from a planar flat member which curves upward to meet a main portion of the arm which is connected to the primary swivel.

The stopper bolt has an adjusting nut for adjusting the length of the stopper bolt in protrusion from the arm. As an arm carries the car door upward after a user opens the car door, the stopper bolt has a ball point tip. The ball point tip is a rolling ball similar to a ballpoint pen construction where a steel ball is mounted on the tip of the stopper bolt. The steel ball point tip rolls on the flat surface of the stopper bracket. The shock both dampens and provides a spring bias for raising and lowering the car door.

The primary swivel member swivels in the same plane as the door hinge base member. The primary swivel member is made as a planar member and the door hinge base member is also made as a planar member. The door hinge base member can be secured to a vehicle on the pair of lower bolt slots and the pair of upper bolt openings into pre-existing bolt receiving openings on the vehicle. However, the middle bolt opening may have to be secured to the vehicle by a bolt after drilling a bolt opening on the vehicle.

The base member bolt can be received in a base member bolt opening. A plurality of base member bolt openings can be disposed on the base member by drilling multiple bolt openings. Having multiple bolt openings allows adjustment for different types of vehicles so that the same door hinge can be used for multiple and varying types of vehicles.

A base stopper is formed as a bolt secured to the door hinge base member. The base stopper has a hexagonal securing means which also raises and lowers the base stopper. The base stopper is adjusted for limiting the angle of the arm relative to the base member after the arm has been raised over the base stopper. The base stopper as a protrusion from the base member is not as preferable as the ball bolt protruding from the arm and rolling on the base member and ramp profile of the base member.

Assembly of the device is slightly complicated by the force of the shock. One way of assembling the device is to first mount the base member to the vehicle chassis. After the base member is mounted to the vehicle chassis, the arm is mounted to the car door. The shock is kept disengaged. The shock can be in the first disengaged position or the second disengaged position. The shock can either be disengaged from base member bolt, or disengaged from shock bracket. The car door can be suspended by rope or a lift during the adjustment process. Once all of the parts are installed on the vehicle, the shock is installed. The door is then released and then the fit is tested. Most of the time, the fit will not be good, and adjustments will be made. The installer has a number of variables such as changing the mounting of the door hinge base member relative to the pair of lower bolt slots, or by fine-tuning an adjusting the stopper finger length via the set screw. The bolt opening slots on the arm can also be adjusted. Furthermore, the base member bolt can be inserted in a different base member bolt opening which is in a slightly different location, to allow for greater bearing on the shock, or less weight-bearing on the shock.

The geometry of the front door hinge provides that the shock remains pivoting in the same plane as the base member. The primary swivel member also pivots in the same plane as the base member and the shock protrusion and thus is on the same plane as the shock, the primary swivel member and the base member. The shock is mounted between the primary swivel member and the base member to allow simultaneous coplanar motion of the primary swivel member, the base member and the shock. The arm swivels outward away from the vehicle chassis and away from base member. The arm is also supported by the base stopper.

In the powered embodiment, the bolt which is the base stopper is omitted. Instead, on the arm, a ball bolt is mounted on the arm. On the exterior surface of the arm, a ball bolt top may protrude from a ball bolt. The ball bolt top can be used for adjusting the height of the ball bolt. The ball bolt has a ball roller which rolls up a ramp profile. The ramp profile may have a bottom opening. The bottom opening can be centered so that a closed position of the arm corresponds with the ball bolt being concentric with the center of the bottom opening. Optionally, the bottom opening can be omitted if the height of the ball bolt does not require that the ball bolt protrude through the bottom opening. The nut adjustment provides a means for adjusting the height of the ball bolt. In actual implementation, the arm is much closer to the base member.

In the powered embodiment, as the motor receives power from input wires, though motor turns a motor gear which rotates an intermediate gear which rotates a gear face formed on swivel member. As the swivel member swivels relative to the base member, the ball bolt in the bottom opening touches the ramp profile and the ball roller begins to roll on the ramp profile which pivots the arm relative to base member on secondary swivel. The arm and base member begin in parallel, until the arm has pivoting moment when the ball roller begins to roll on ramp profile. The arm is automatically raised thereby. The ball roller can be of similar or larger diameter than the ball tip. Because the shock provides a raising force against the arm, and the car door attached to the arm, the shock provides the motor with the bulk of the raising force. The motor can thus be made smaller as it does not need to provide all of the raising force for raising the arm and the car door attached to the arm.

The power on input wires is preferably an automotive voltage standard. The power on the input wires is preferably regulated by a remote control. A remote control unit sending a wireless signal can activate a receiver connected to the input wires. The receiver can therefore pop the door lock with a door popper and simultaneously raise the car door vertically with the assistance of the shock. Several miniaturized receivers are commercially available for ready installation. In this manner, a user walking out to a car can press a button on a remote control that is located on the user's keychain, and the car door will automatically unlock and raise itself. Once in the cabin, the user can press a button which is also wired and connected to the receiver so that the door will automatically lower, close and lock.

In the highest position, the ball roller is preferably rolling on the surface of the base member. As the ball roller rolls back down, it rolls over the flat surface of the base member, then down the ramp profile and into the bottom opening, where the ball roller is hanging free and not touching the ramp profile.

The ball bolt top can be omitted if the bolt is threaded directly into base member without protruding through the face of base member. In this embodiment, the ball bolt cannot be seen from the outside.

Figure 1:
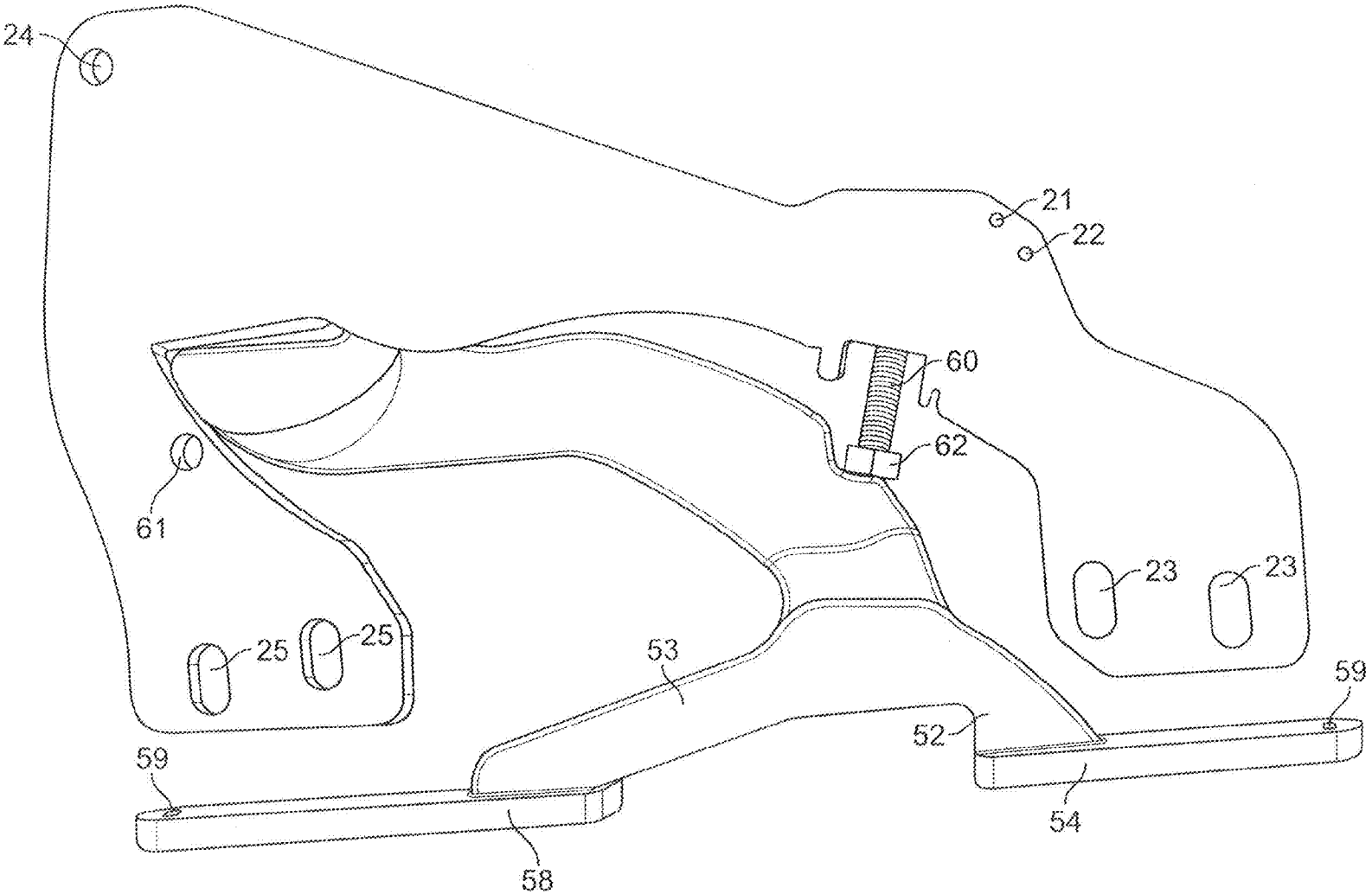
FIG. 1 is an inside view of the present invention from the perspective from the inside of an automobile.
Figure 2:
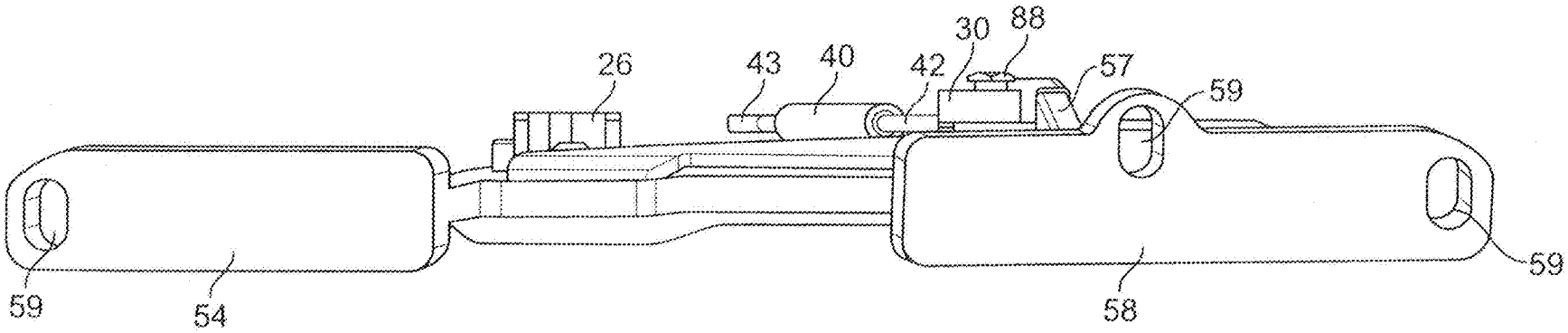
FIG. 2 is a rear view of the present invention.
Figure 3:
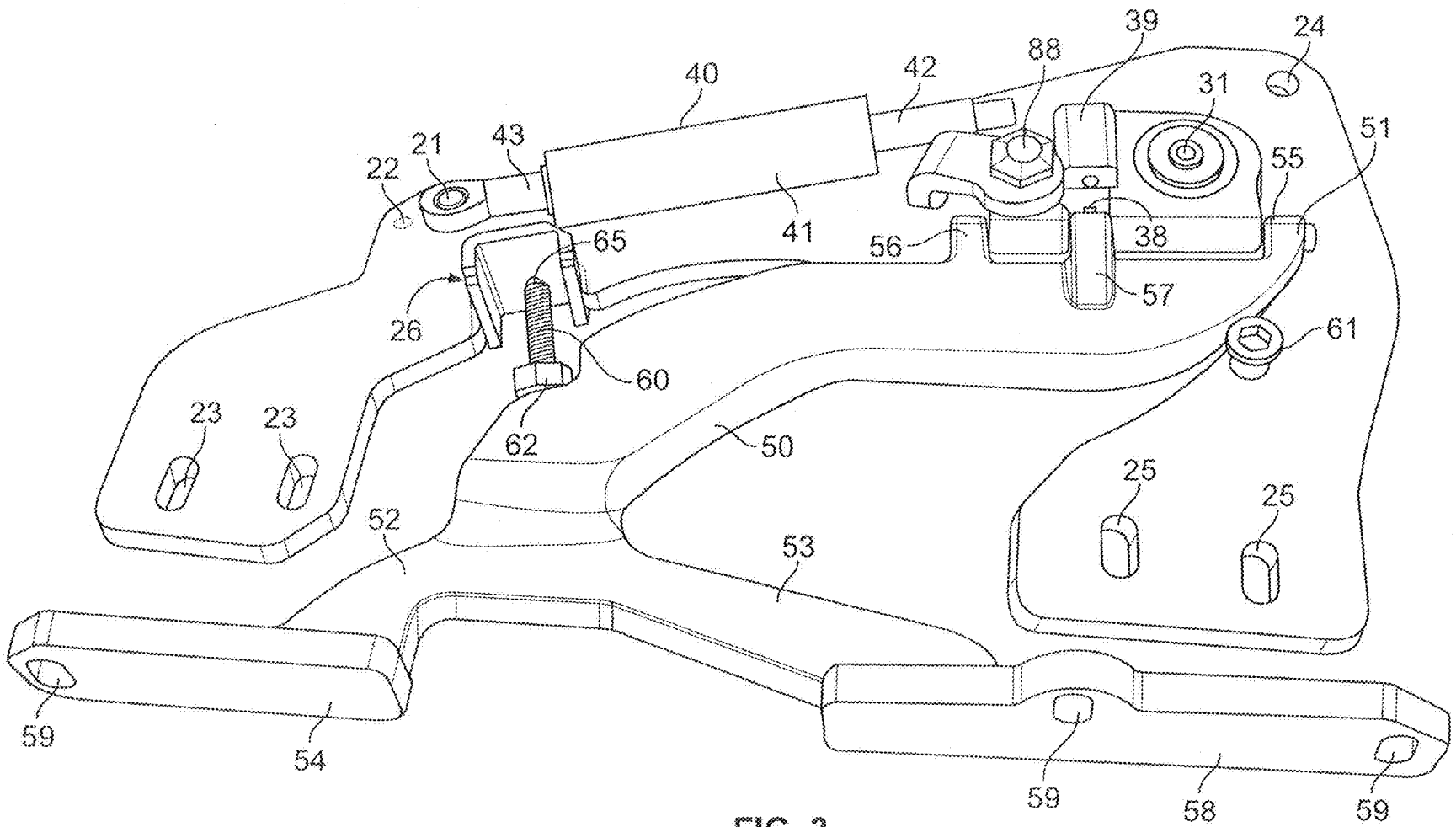
FIG. 3 is an outside view of the present invention in closed position, showing the shock in a first disengaged position.
Figure 4:
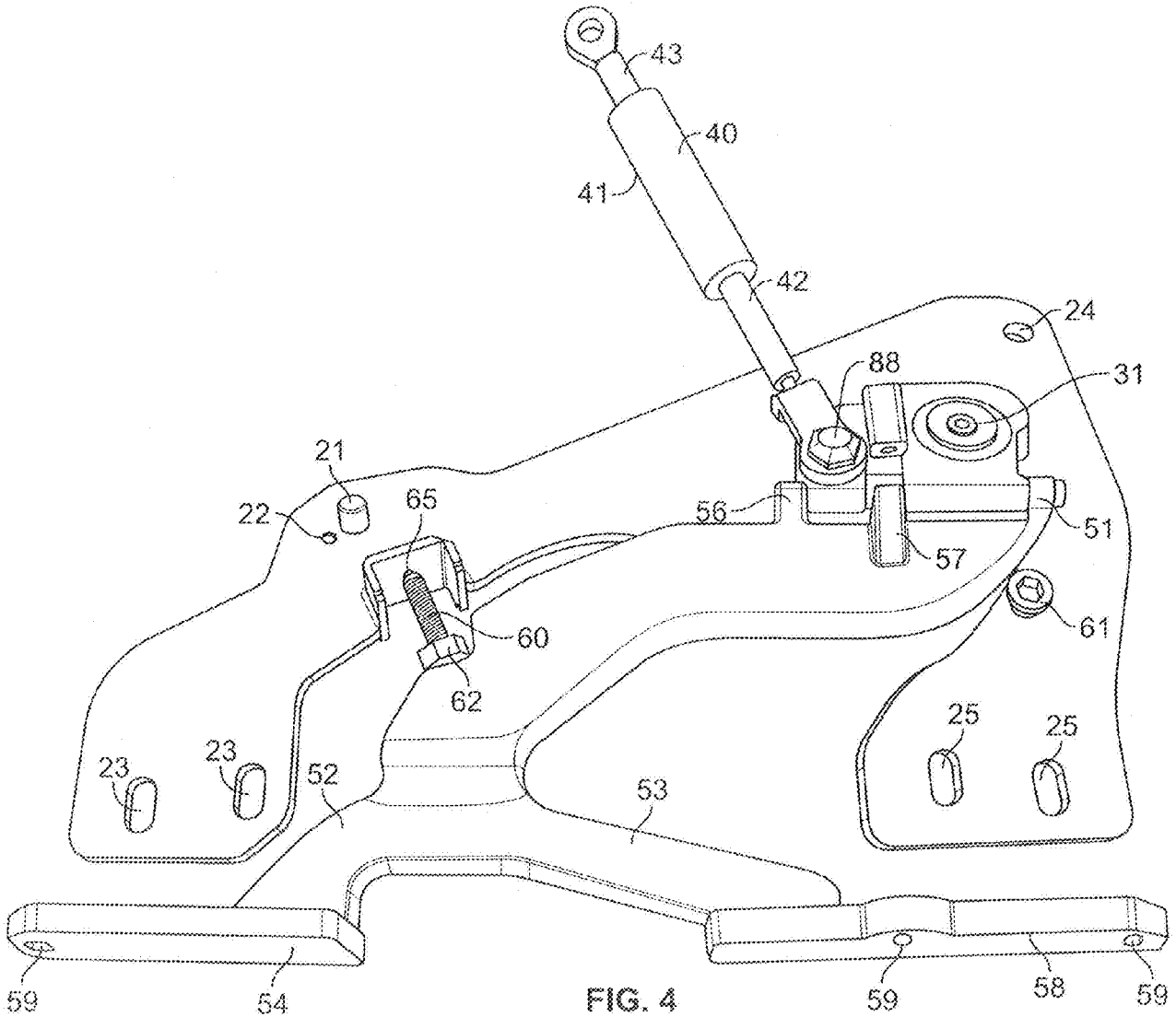
FIG. 4 is an outside view of the present invention in closed position, showing the shock in a second disengaged position.

The following call out list of elements is used consistently to refer to the elements of the drawings as follows:

Base Member
21 Bolt
23 Lower Bolt Slots
24 Middle Bolt Opening
25 Upper Bolt Openings
26 Stopper Bracket
30 Swivel Member
31 Swivel Axle
32 Shock Protrusion
33 Opening
34 Shock Bracket
38 Screw
39 Stopper
40 Shock
41 Outer Cylinder
42 Piston
43 Banjo Receiver
50 Arm
51 Secondary Swivel
52 First Branch Member
53 Second Branch Member
54 Door Plate
55 Connection Finger
56 Connection Finger
57 Stopper Finger
58 Door Plate
59 Bolt Opening Slots
60 Stopper Bolt
61 Base Stopper
62 Adjusting Nut
65 Ball Tip
88 Shock Bracket Bolt
121 Nut Adjustment
130 Motor
131 Input Wires
132 Intermediate Gear
133 Gear Face
188 Ball Bolt
182 Bottom Opening
190 Ramp Profile
888 Ball Roller
122 Ball Bolt Top
134 Piston Extension
135 Piston Extension Bolt
136 Piston Extension Aperture
137 Swivel Member First Motor Mounting
138 Swivel Member Second Motor Mounting
220 Reversible Base Member
226 Stopper Bolt Stopper
228 Outside Motor Mounting Opening
229 Inside Motor Mounting Opening
230 Reversible Swivel Member
237 Motor Mounting Aperture
238 Toggle Adjustment Screw
239 Toggle Stopper
240 Shock Piston
241 Reversible Shock Piston Lower Mount
242 Reversible Shock Piston Upper Mount
243 Shock Piston Extension Aperture
244 Shock Piston Mounting Aperture
245 Reversible Swivel Member Piston Mount Aperture
250 Reversible Arm
251 Reversible Swivel Member Swivel Bolt
252 Branch Member
259 Reversible Bolt Opening Slots
261 Reversible Base Stopper
262 Stopper Bolt Stopper Mounting Bolt
263 Stopper Bolt Stopper Mounting Opening
288 Wire Harness Switch
289 Wire Harness
291 Reversible Arm Securing Screw
292 Reversible Arm Securing Screw Aperture
293 Reversible Branch Member Securing Aperture
294 Lower Reversible Riser
295 Upper Reversible Riser
296 Lower Reversible Riser Openings
297 Upper Reversible Riser Openings
301 First Reversible Arm Finger
302 Second Reversible Arm Finger
303 Third Reversible Arm Finger
304 Second Reversible Arm Gap
305 First Reversible Arm Gap
306 First Swivel Member Finger
307 First Swivel Member Gap
308 Second Swivel Member Finger
309 Second Swivel Member Gap
310 Third Swivel Member Finger
315 Adjustable Clip
321 Intermediate Bolting Slot
341 Base Stopper Adjustment Aperture

DETAILED DESCRIPTION OF THE PREFERRED EMBODIMENT

The door hinge is comprised of a base member 20, upon which a primary swivel member 30 is mounted. The primary swivel has a shock protrusion 32 receiving a shock bracket 34 which has a first face parallel to the shock protrusion and a second face facing the shock. The shock bracket 34 is in swivel connection to the primary swivel member 30 the shock bracket 34 has a shock bracket bolt 88 bolted through the primary swivel member 30 and the shock bracket 34 in a thickness direction. The shock bracket bolt 88 preferably has a lower portion that is threaded into an aperture of the primary swivel member 30. The shock bracket bolt 88 as a hexagonal head for allowing assembly and adjustment while the shock bracket bolt 88 is mounted under the fender of the vehicle. Thus, the shock bracket has a shock bracket axis of rotation parallel to the primary swivel axis.

The shock 40 has an outer cylinder 41 and a piston 42 in telescopic connection to the outer cylinder 41. The outer cylinder 41 is connected to a banjo receiver 43. The banjo receiver 43 is in threaded connection and intimate connection with a base member bolt 21. The base member bolt 21 has an external threading which preferably threads with an inside surface of the banjo receiver 43.

The door hinge base member 20 has a pair of lower bolt slots 23 and a middle bolt opening 24 and a pair of upper bolt openings 25. The bolt openings and bolt slots are sized for standard automobile door hinge securing. The standard automobile door hinge can be replaced with the present embodiment door hinge.

In the unpowered embodiment as seen in FIGS. 1-6, a stopper bracket 26 is formed on the base member 20 and has a vertical face facing a stopper bolt 60 disposed on the arm. The stopper bracket 26 is preferably formed as a U-shaped member with a flat face facing the stopper bolt 60 and providing a good rolling surface for a ball tip 65. The ball tip 65 is mounted to the tip of the stopper bolt and the ball tip can roll in any direction like a ballpoint pen relative to the stopper bolt 60. Preferably, the ball tip 65 is oiled for smooth rolling.

The shock 40 pushes the arm 50 into an extended position corresponding to the opening of a car door. The arm 50 is attached to the primary swivel member 30 at a secondary swivel 51. The secondary swivel swivels outward to allow a car door mounted to the end of arm 50 to open outwardly. The swivel axis is on the swivel axle 31 passing through the swivel member 30 and the base member 20. The secondary swivel 51 passes first through the arm 50 at a first connection finger 55, then the primary swivel member 30, before attaching began to the arm 50 at a second connection finger 56. The secondary swivel axis is normal to the primary swivel axis.

The secondary swivel 51 is limited in outward opening angle by a stopper finger 57 which opposes a stopper 39 on primary swivel 30. The stopper finger is formed as a protrusion on the arm 50. The stopper 39 may have an opening 33 on a side opposite to the stopper finger 57. The opening optionally allows access to an adjusting member such as a screw. The adjusting member may have an engagement face such as a hexagonal drive for adjusting. The opening on a side opposite to the stopper finger 57 may provide access to the hexagonal drive. Preferably, the secondary swivel 51 has an axle for rotation which passes through stopper finger 57 as well as first connection finger 55 and second connection finger 56.

A set screw 38 may be threaded and secured into the stopper finger 57 to provide an extension or retraction for adjustment of the maximum outward opening angle. Extension of set screw 38 decreases the maximum outward opening angle and retraction of set screw 38 increases the maximum outward opening angle. The maximum outward opening angle is sized according to a car door dimension. The set screw may have a means for adjusting, such as a Phillips or hexagonal drive surface.

The arm 50 has a pair of branch members including a lower branch member 52 and an upper branch member 53. The lower branch member is secured to a lower door plate 54 and the upper branch member is secured to an upper door plate 58. The lower door plate 54 and the upper door plate 58 have bolt opening slots 59 receiving bolts securing to a car door. The upper branch member and the lower branch member are preferably made from a planar flat member which curves upward to meet a main portion of the arm 50 which is connected to the primary swivel 30.

The stopper bolt 60 has an adjusting nut 62 for adjusting the length of the stopper bolt 60 in protrusion from the arm 50. As an arm 50 carries the car door upward after a user opens the car door, the stopper bolt 60 has a ball point tip 65. The ball point tip is a rolling ball similar to a ballpoint pen construction where a steel ball is mounted on the tip of the stopper bolt 60. The steel ball point tip 65 rolls on the flat surface of the stopper bracket 26. The shock both dampens and provides a spring bias for raising and lowering the car door.

The primary swivel member swivels in the same plane as the door hinge base member 20. The primary swivel member is made as a planar member and the door hinge base member 20 is also made as a planar member. The door hinge base member 20 can be secured to a vehicle on the pair of lower bolt slots 23 and the pair of upper bolt openings 25 into pre-existing bolt receiving openings on the vehicle. However, the middle bolt opening 24 may have to be secured to the vehicle by a bolt after drilling a bolt opening on the vehicle.

The base member bolt 21 can be received in a base member bolt opening. A plurality of base member bolt openings can be disposed on the base member 20 by drilling multiple bolt openings 21, 22. Having multiple bolt openings allows adjustment for different types of vehicles so that the same door hinge can be used for multiple and varying types of vehicles. The multiple bolt openings can optionally be plugged when not in use.

A base stopper 61 is formed as a bolt secured to the door hinge base member 20. The base stopper 61 has a hexagonal securing means which also raises and lowers the base stopper 61. The base stopper 61 is adjusted for limiting the angle of the arm 50 relative to the base member 20 after the arm 50 has been raised over the base stopper 61. The base stopper biases the arm away from the base position when the arm is an extended position.

Figure 5:
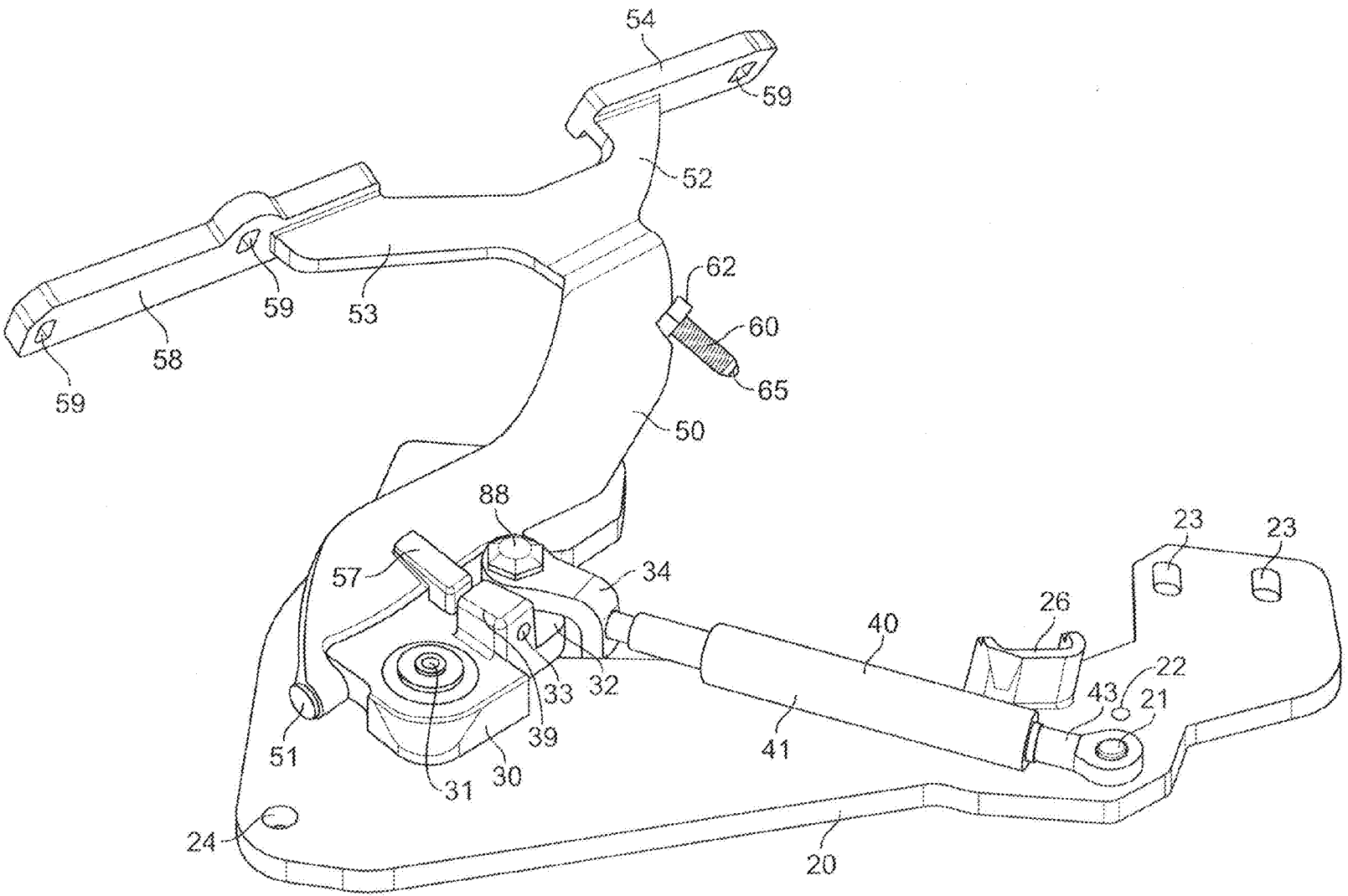
FIG. 5 is an outside view of the present invention in open and extended position, showing the shock in an engaged position.
Figure 6:
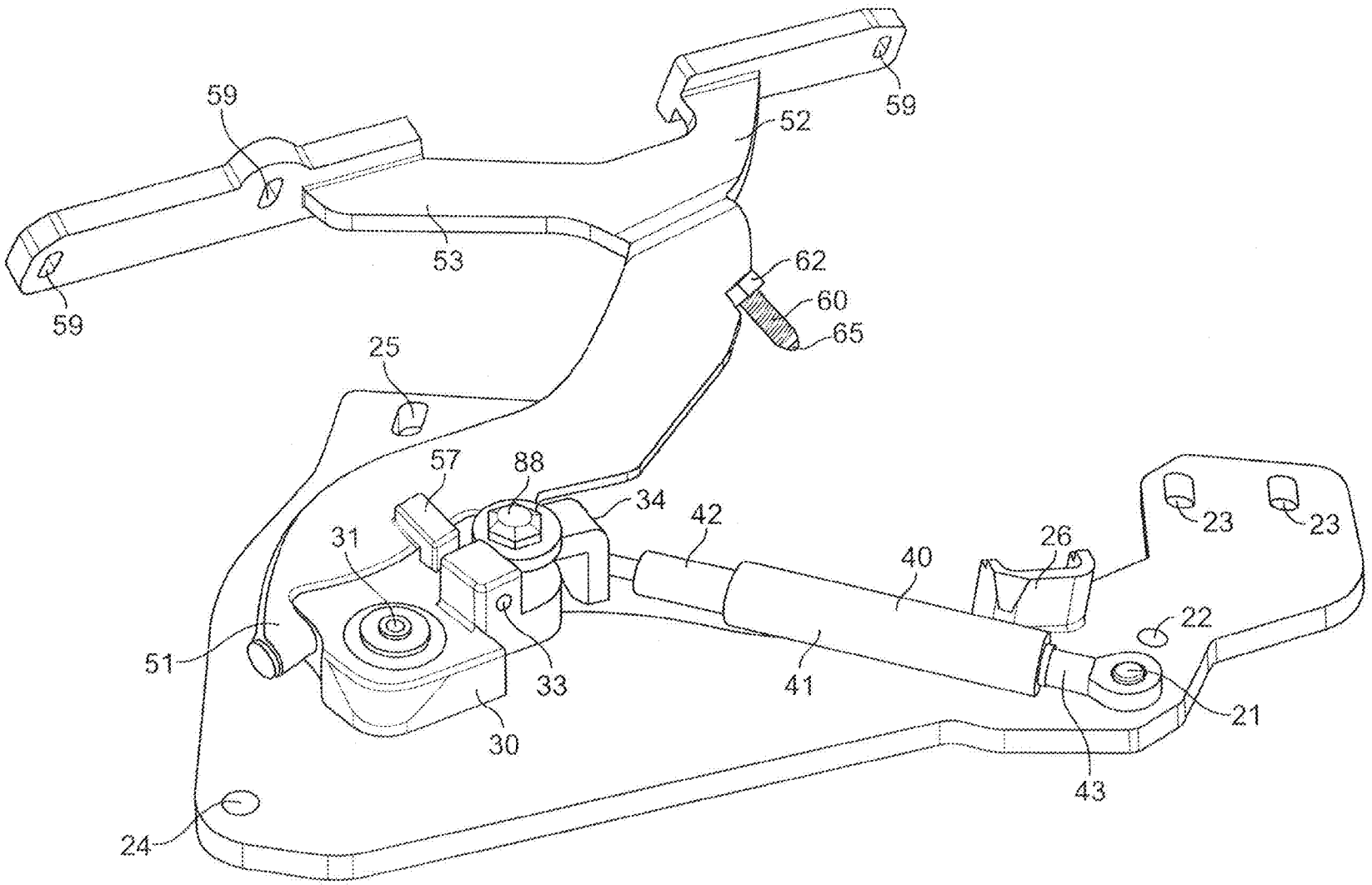
FIG. 6 is an outside view of the present invention in open and slightly retracted position, showing the shock in an almost engaged position right before final installation as shown in FIG. 5.
Figure 7:
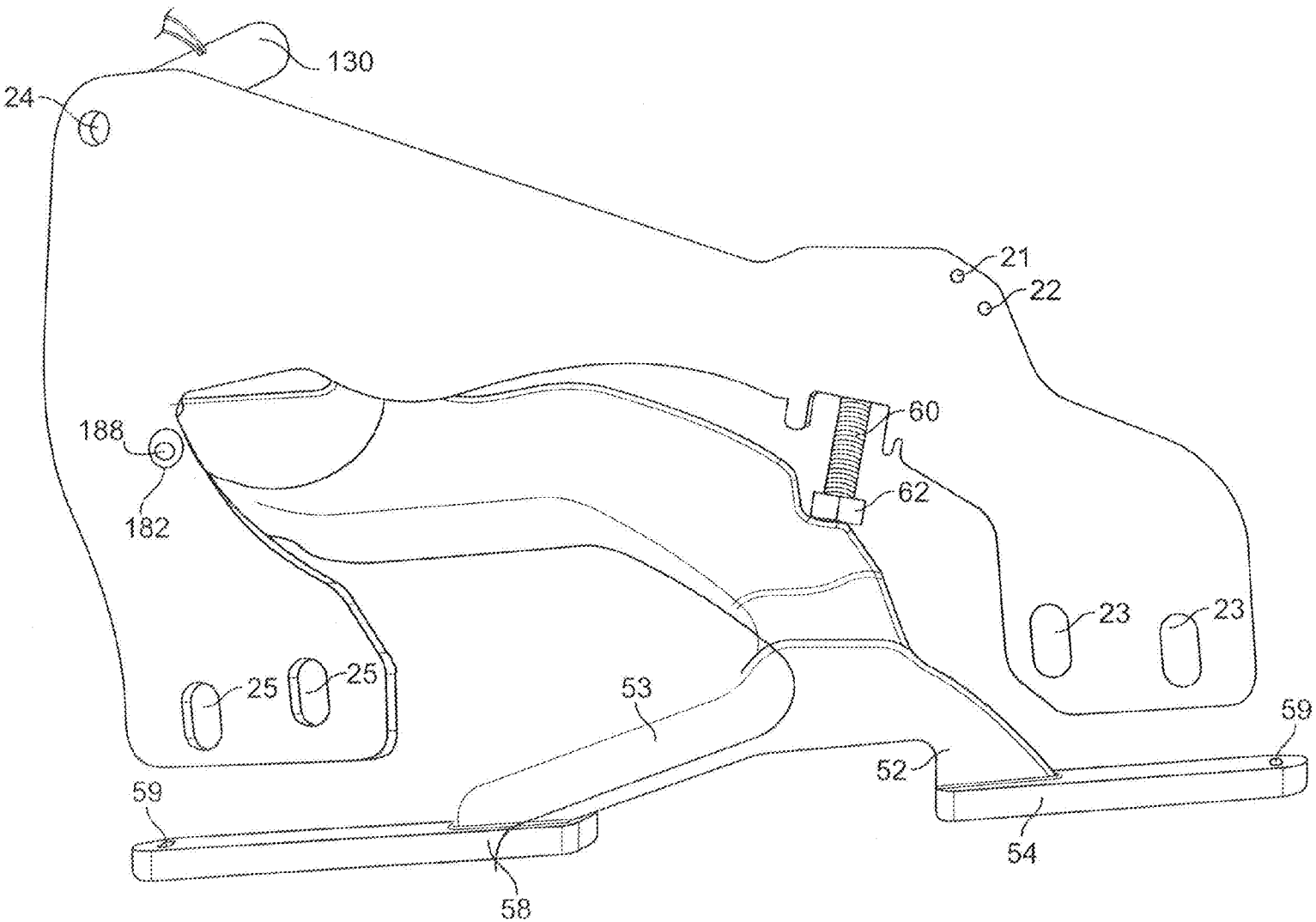
FIG. 7 is an inside view of the powered embodiment.
Figure 8:
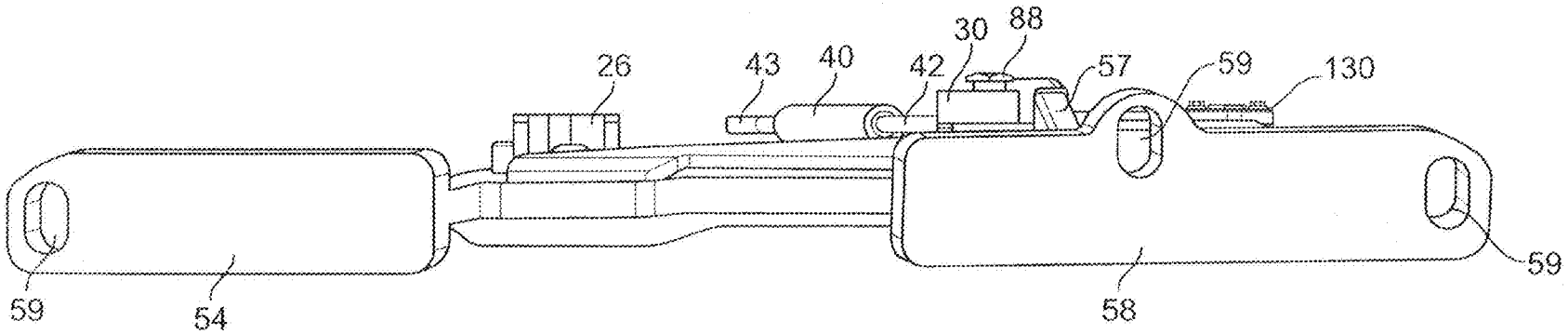
FIG. 8 is a rear view of the powered embodiment.
Figure 9:
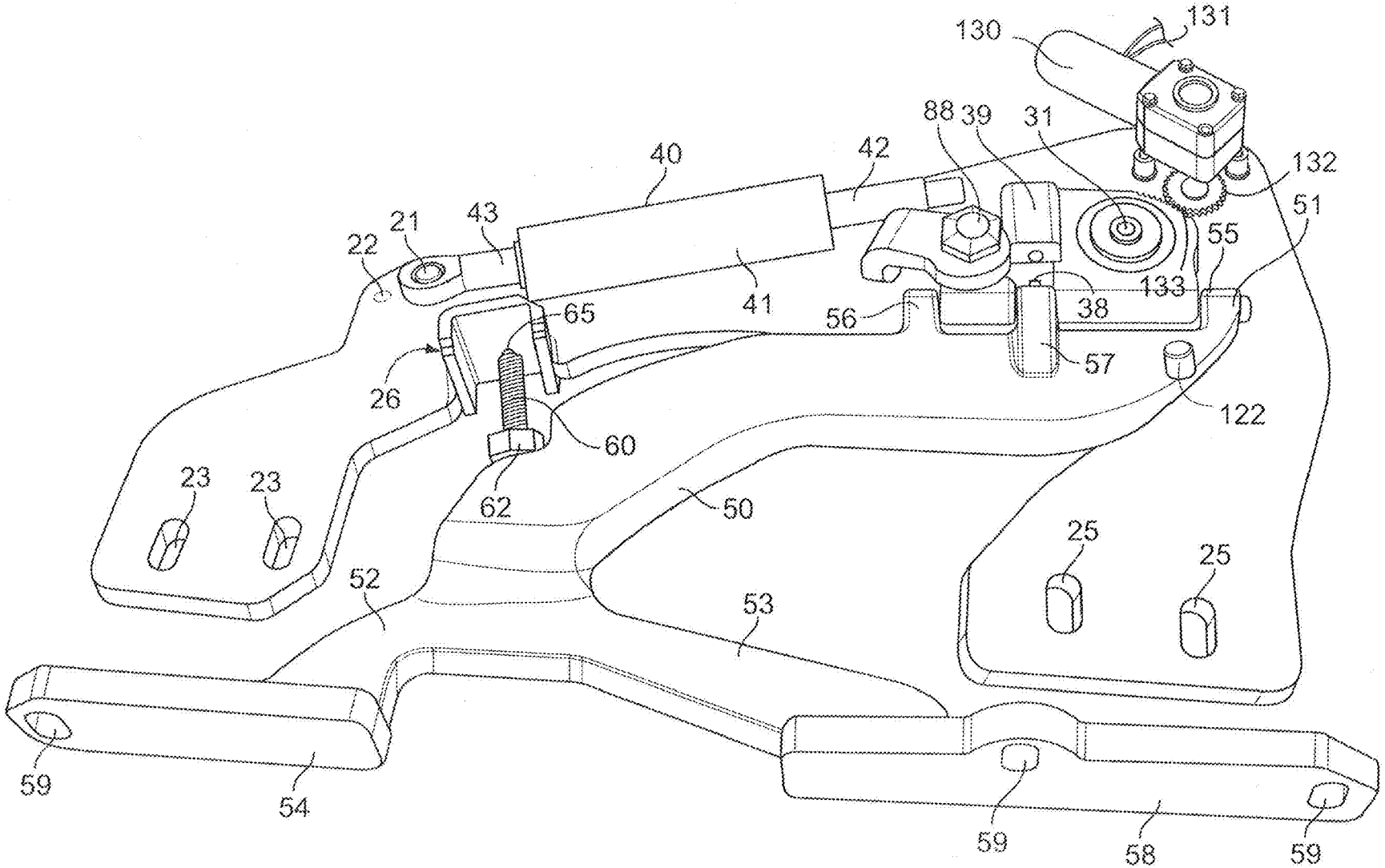
FIG. 9 is an outside view of the powered embodiment in closed position showing the shock in a first disengaged position.
Figure 10:
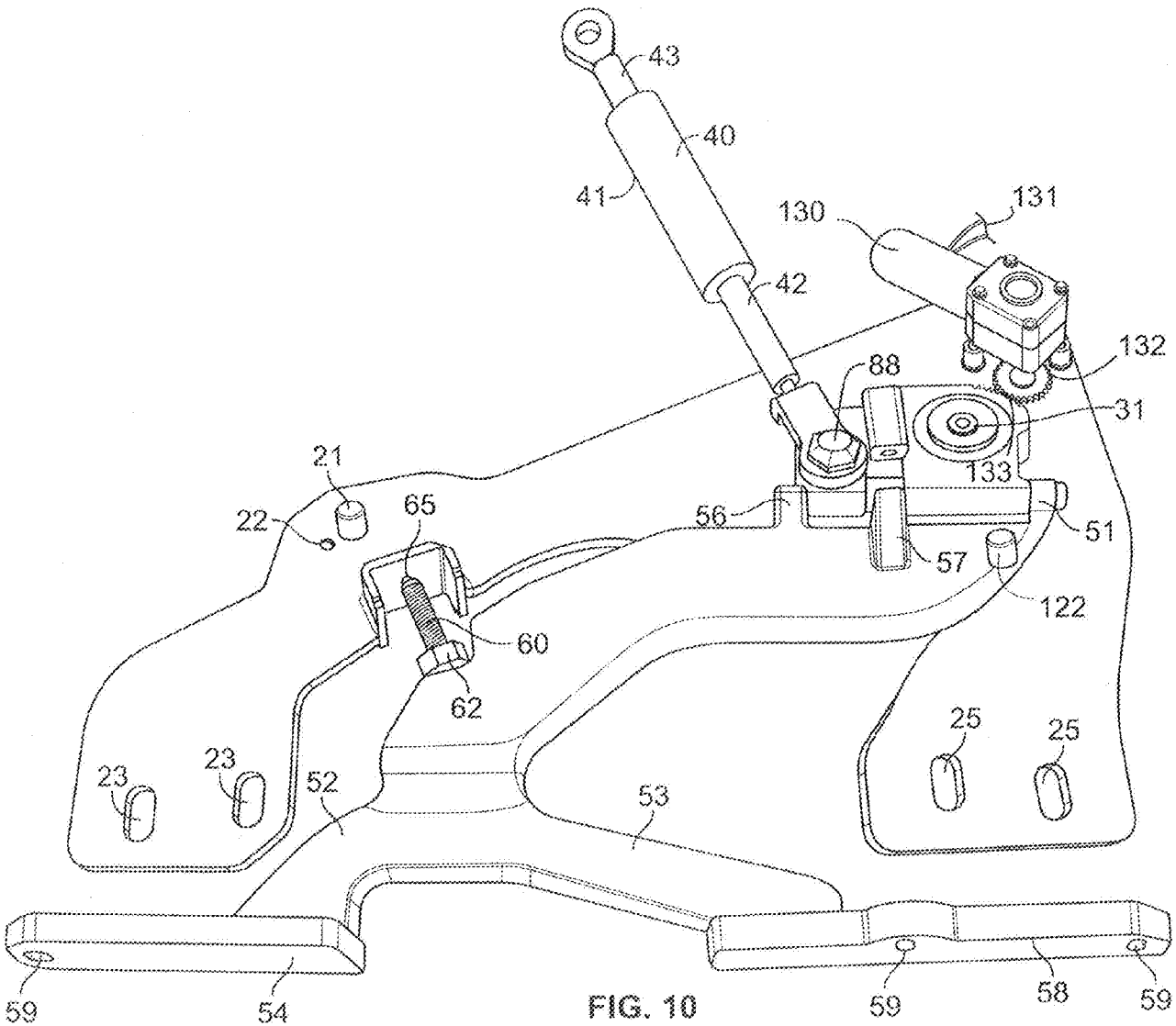
FIG. 10 is an outside view of the powered embodiment in closed position showing the shock in a second disengaged position.
Figure 11:
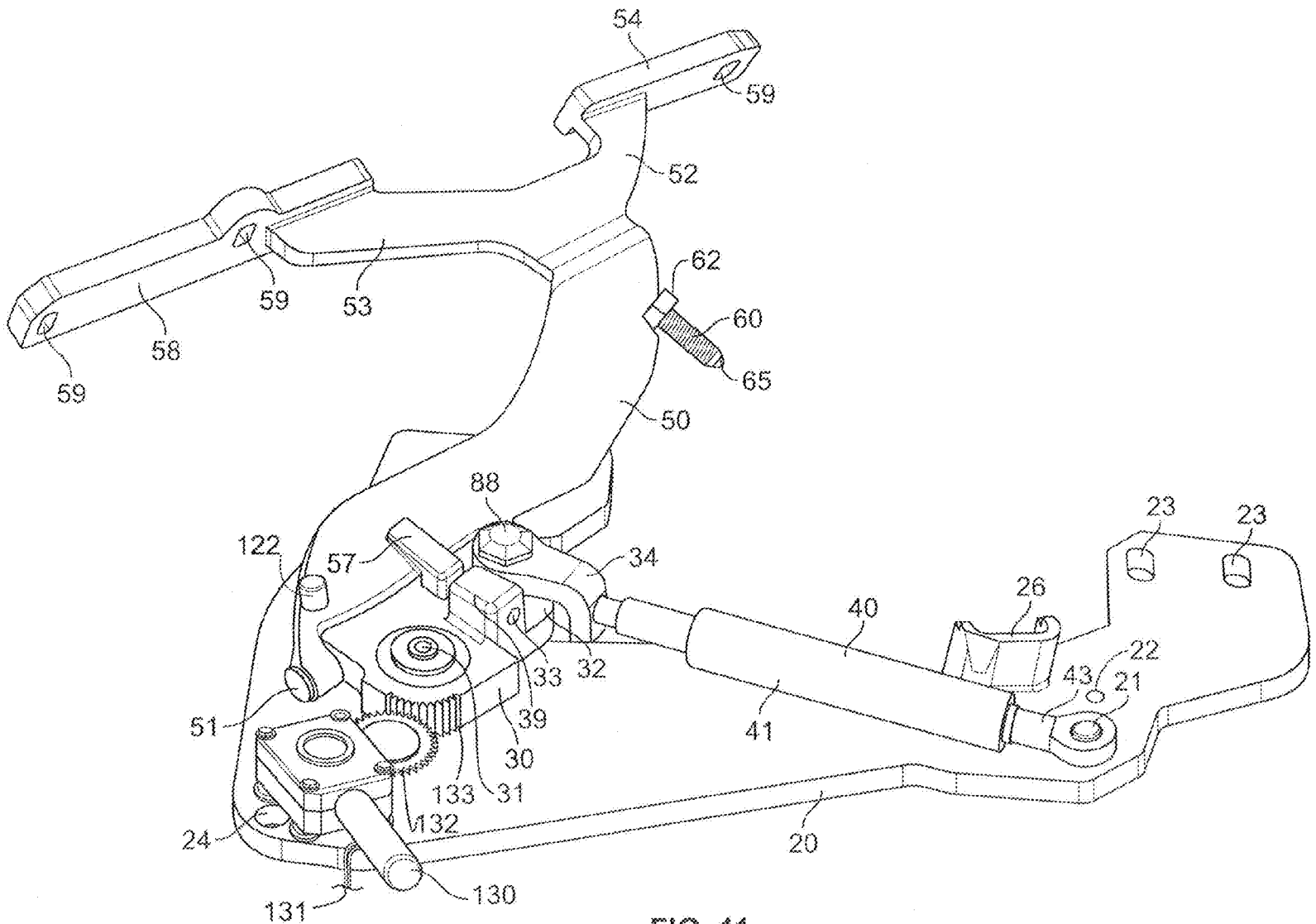
FIG. 11 is an outside view of the powered embodiment in open and extended position, showing the shock in an engaged position.
Figure 12:
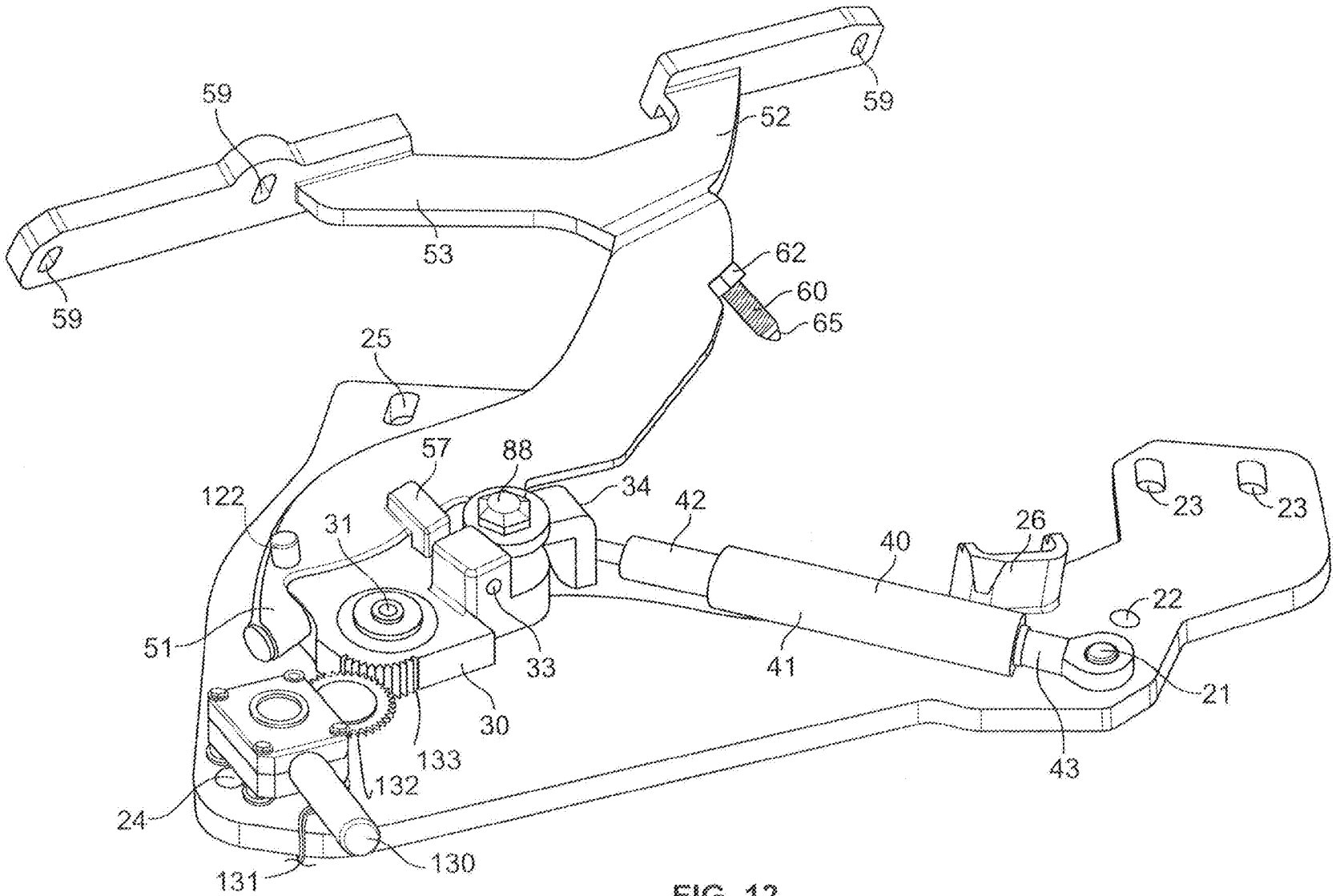
FIG. 12 is an outside view of the powered embodiment in an open and slightly retracted position, showing the shock in an almost engaged position right before final installation.

Assembly of the device is slightly complicated by the force of the shock 40. One way of assembling the device is to first mount the base member 20 to the vehicle chassis. After the base member 20 is mounted to the vehicle chassis, the arm 50 is mounted to the car door. The shock is kept disengaged as seen in FIG. 2, 3, 4 or 6. The shock can be in the first disengaged position or the second disengaged position. The shock can either be disengaged from base member bolt 21, or disengaged from shock bracket 34. The car door can be suspended by rope or a lift during the adjustment process. Once all of the parts are installed on the vehicle, the shock is installed as seen in FIG. 5. The door is then released and then the fit is tested. Most of the time, the fit will not be good, and adjustments will be made. The installer has a number of variables such as changing the mounting of the door hinge base member relative to the pair of lower bolt slots 23, or by fine-tuning an adjusting the stopper finger length via the set screw. The bolt opening slots 59 on the arm 50 can also be adjusted. Furthermore, the base member bolt 21 can be inserted in a different base member bolt opening which is in a slightly different location, to allow for greater bearing on the shock, or less weight-bearing on the shock. The different base member bolt opening is called the secondary base member bolt opening 22. The secondary base member bolt opening is preferably adjacent to the primary base member bolt opening.

The air shock is preferably loaded up to about 50% of its travel distance capacity, and no more than 75% of the travel distance capacity. The half loading of the shock is accomplished by sizing the shock so that it is 50% loaded when the door is closed. A shock is loaded half way when the piston travels half of its distance in telescopic contraction into the shock body. When the vehicle door is closed, the apparatus arm is in retracted position as opposed to an extended position when the door is open. The air shock pushes outwardly in telescopic orientation. The shock has an area of trapped air and a base for storing the trapped air. The air shock can be selected from a variety of commonly available shocks. By opening the door, and holding it open with a lifting device, the shock can be replaced if necessary, such as if it fails. Typically, the shock will be loaded between 40% and 75% depending on the door structure and the motion desired by the user.

The geometry of the front door hinge provides that the shock remains pivoting in the same plane as the base member 20. The primary swivel member also pivots in the same plane as the base member 20 and the shock protrusion 32 and thus is on the same plane as the shock, the primary swivel member and the base member 20. The shock is mounted between the primary swivel member and the base member to allow simultaneous coplanar motion of the primary swivel member, the base member and the shock. The arm 50 swivels outward away from the vehicle chassis and away from base member 20. The arm 50 is also supported by the base stopper 61.

Fabrication of the parts is preferably from steel plate of sufficient thickness to support the car door. Preferably, ⅜" plate is used. The parts can be welded together, such as the stopper bracket 26 which is preferably welded to the base member 20. The swivel joints can be substituted with a joint having the same or greater degree of freedom.

Figure 13:
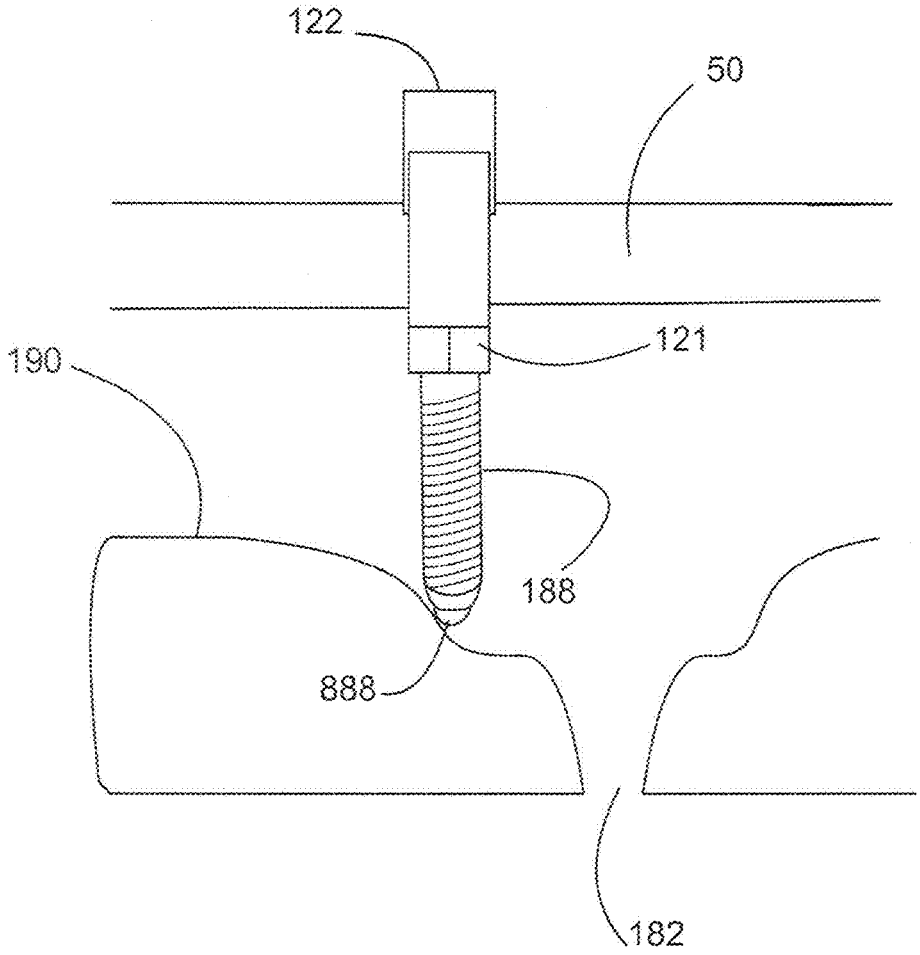
FIG. 13 is a vertically exaggerated cross-section diagram showing the ball roller rolling up the ramp.
Figure 14:
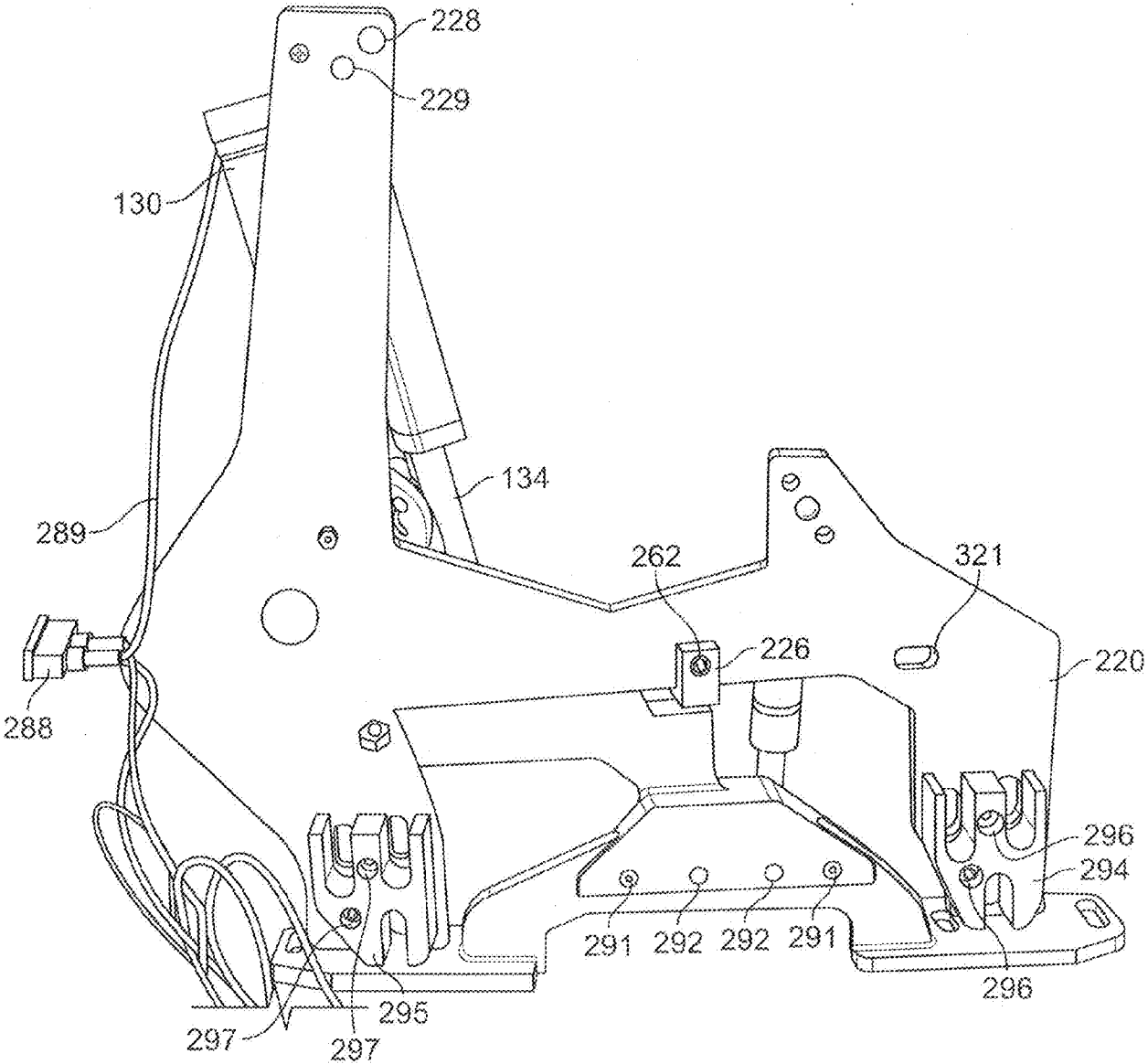
FIG. 14 is a side perspective view of the hinge showing assembly of the hinge.
Figure 15:
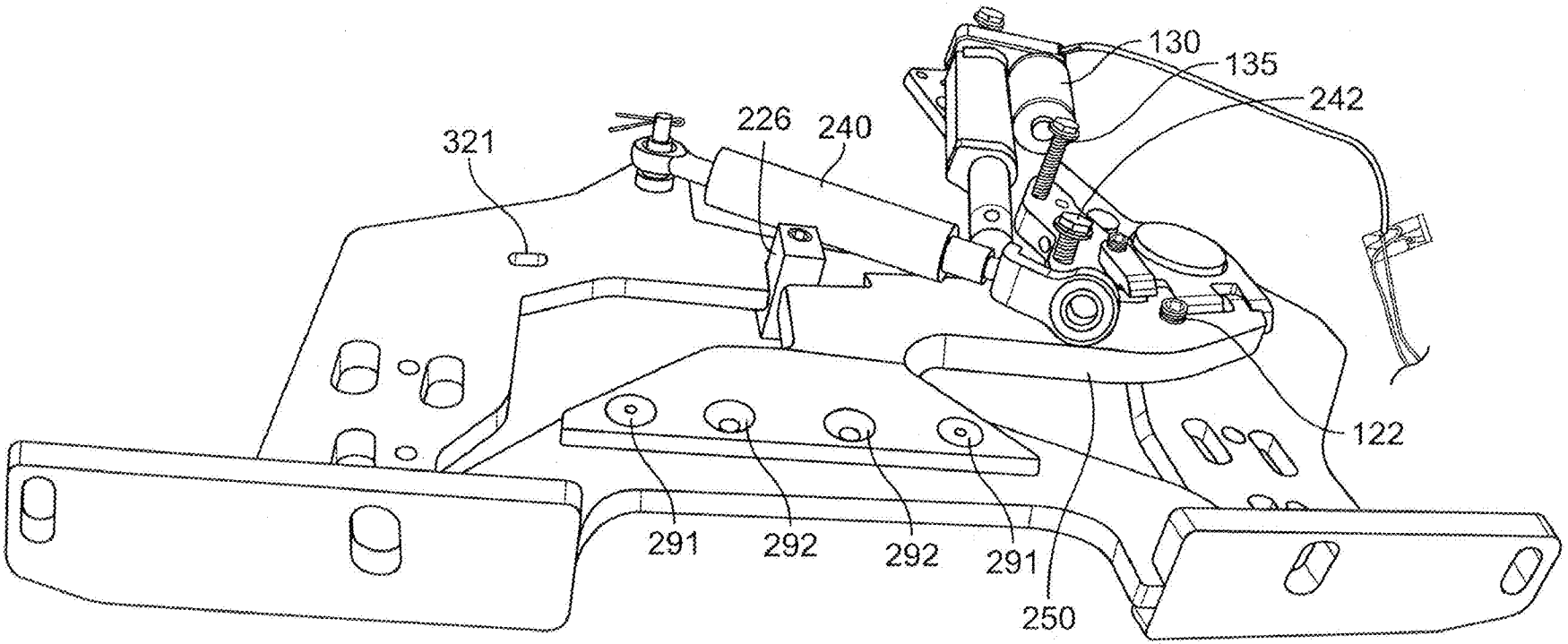
FIG. 15 is a perspective view of the hinge in closed position showing assembly of the hinge.
Figure 16:
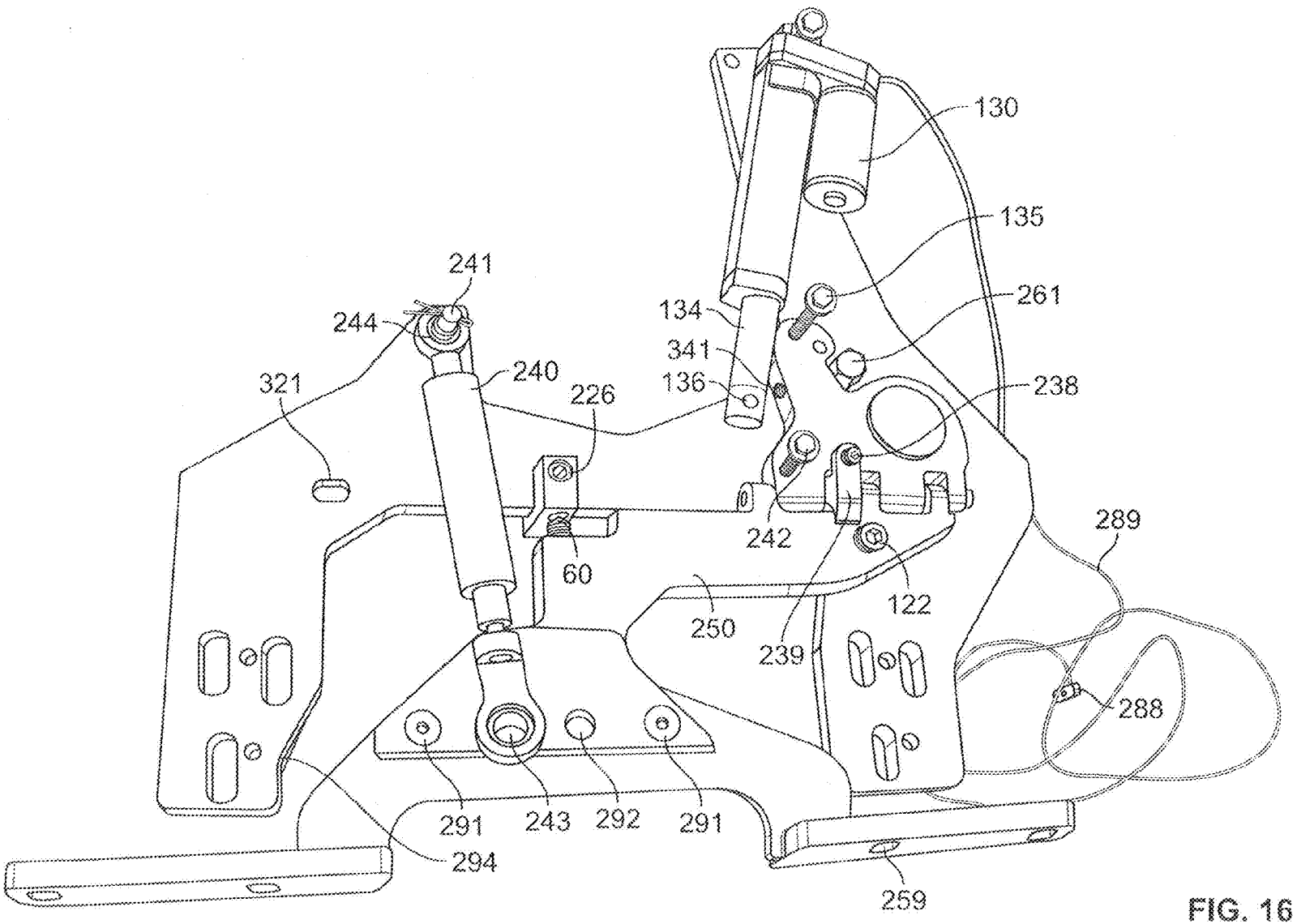
FIG. 16 is a perspective view of the hinge in closed position showing assembly of the hinge.
Figure 17:
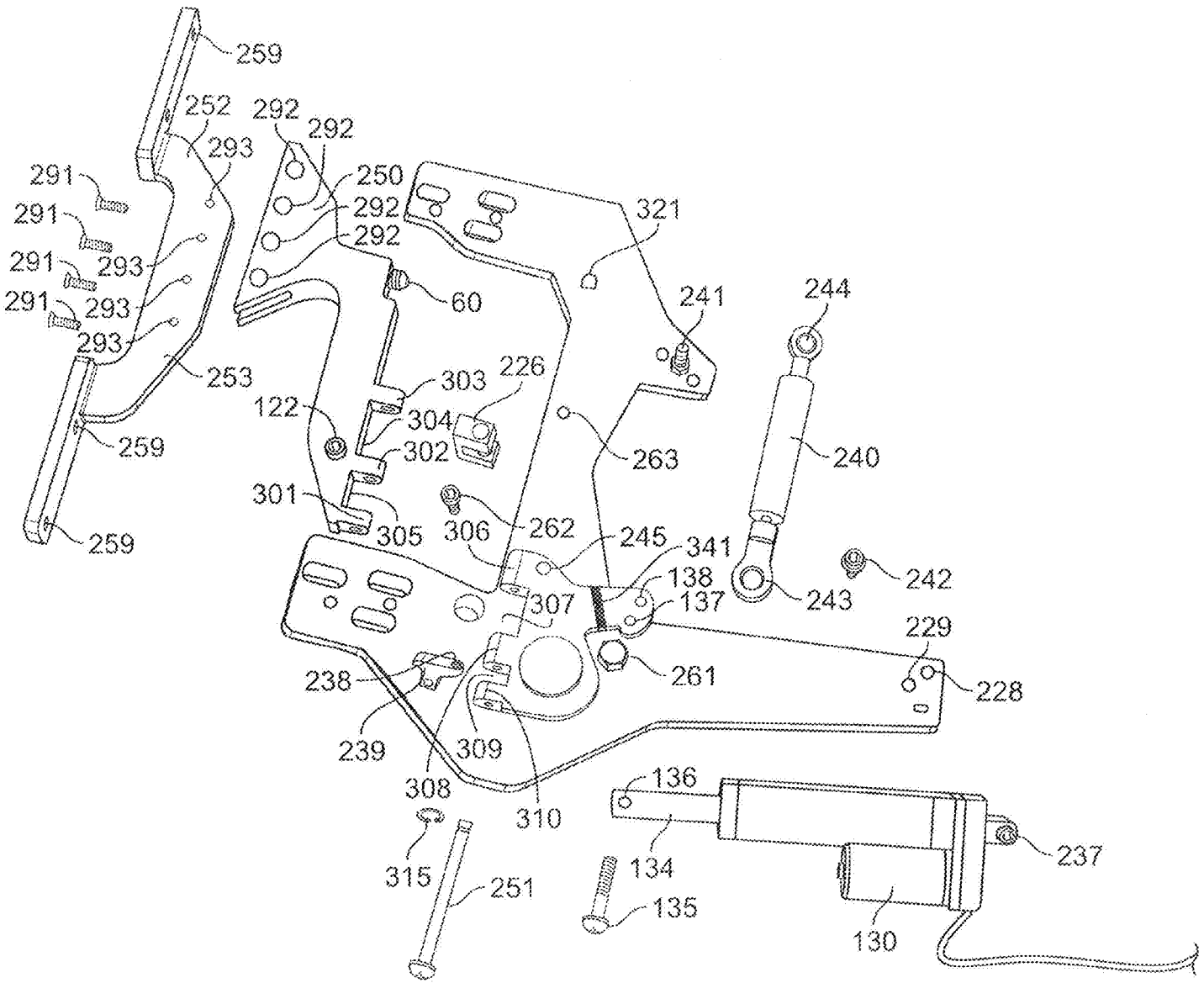
FIG. 17 is a perspective exploded view of the hinge showing assembly of the hinge.

In the powered embodiment as seen in FIGS. 7-13, the bolt which is the base stopper 61 is omitted. Instead, on the arm 50, a ball bolt 188 is mounted on the arm. On the exterior surface of the arm 50, a ball bolt top 122 may protrude from a ball bolt 188. The ball bolt top 122 can be used for adjusting the height of the ball bolt 188. The ball bolt 188 has a ball roller 888 which rolls up a ramp profile 190. The ramp profile 190 may have a bottom opening 182. The bottom opening 182 can be centered so that a closed position of the arm 50 corresponds with the ball bolt 188 being concentric with the center of the bottom opening 182. Optionally, the bottom opening can be omitted if the height of the ball bolt 188 does not require that the ball bolt protrude through the bottom opening. As seen in FIG. 13 the dimensions of which are is exaggerated for purposes of clarity, the nut adjustment 121 provides a means for adjusting the height of the ball bolt 188. In actual implementation, the arm 50 is much closer to the base member 20.

In the powered embodiment, as the motor 130 receives power from input wires 131, though motor turns a motor gear which rotates an intermediate gear 132 which rotates a gear face 133 machine formed on swivel member 30. The gear face 133 can be formed in a corner of the swivel member 30. Preferably, the height of the gear face 133 is equivalent to the height of the intermediate gear 132 which is consequently equivalent to the height of the motor gear. The motor gear is the gear that shares an axis with the motor, from which the motor outputs torque. The intermediate gear is mounted between the motor gear and the gear face 133.

As the swivel member 30 swivels relative to the base member 20, the ball bolt 188 in the bottom opening 182 touches the ramp profile 190 and the ball roller 888 begins to roll on the ramp profile 190 which pivots the arm 50 relative to base member 20 on secondary swivel 51. The arm 50 and base member 20 begin in parallel, until the arm 50 has pivoting moment when the ball roller 888 begins to roll on ramp profile 190. The arm is automatically raised thereby. The ball roller 888 can be of similar or larger diameter than the ball tip 65. Because the shock 40 provides a raising force against the arm 50, and the car door attached to the arm 50, the shock 40 provides the motor 130 with the bulk of the raising force. The motor 130 can thus be made smaller as it does not need to provide all of the raising force for raising the arm 50 and the car door attached to the arm 50.

The power on input wires 131 is preferably a 12V automotive voltage standard. The power on the input wires is preferably regulated by a remote control. A remote control unit sending a wireless signal can activate a receiver connected to the input wires. The receiver can therefore pop the door lock with a door popper and simultaneously raise the car door vertically with the assistance of the shock 40. Several miniaturized 12V receivers are commercially available for ready installation. In this manner, a user walking out to a car can press a button on a remote control that is located on the user's keychain, and the car door will automatically unlock and raise itself. Once in the cabin, the user can press a button which is also wired and connected to the receiver so that the door will automatically lower, close and lock.

The motor can be a stepping motor which is not movable or locked when powered off, or the motor can be movable when powered off. It is preferred that the motor can be movable when powered off so that a user can open the car door manually should the user desire to do so.

In the highest position, the ball roller 888 is preferably rolling on the surface of the base member 20. As the ball roller 888 rolls back down, it rolls over the flat surface of the base member 20, then down the ramp profile 190 and into the bottom opening 182, where the ball roller 888 is hanging free and not touching the ramp profile 190. The ball roller 888 is similar to the ball tip 65 because both are mounted to the tip of a bolt and the ball can roll in any direction like a ballpoint pen relative to the stopper bolt 60, or relative to the ball bolt 188. Preferably, both the ball roller 888 and the ball tip 65 are both oiled for smooth rolling.

The ball bolt top 122 can be omitted if the bolt is threaded directly into base member 20 without protruding through the face of base member 20. In this embodiment, the ball bolt 188 cannot be seen from the outside. The ball roller 888 is mounted for free rotation within the tip of the ball bolt 188. Exterior surface of the ball bolt 188 is threaded and can be threaded into a threaded aperture on the underside of arm 50.

Figure 18:
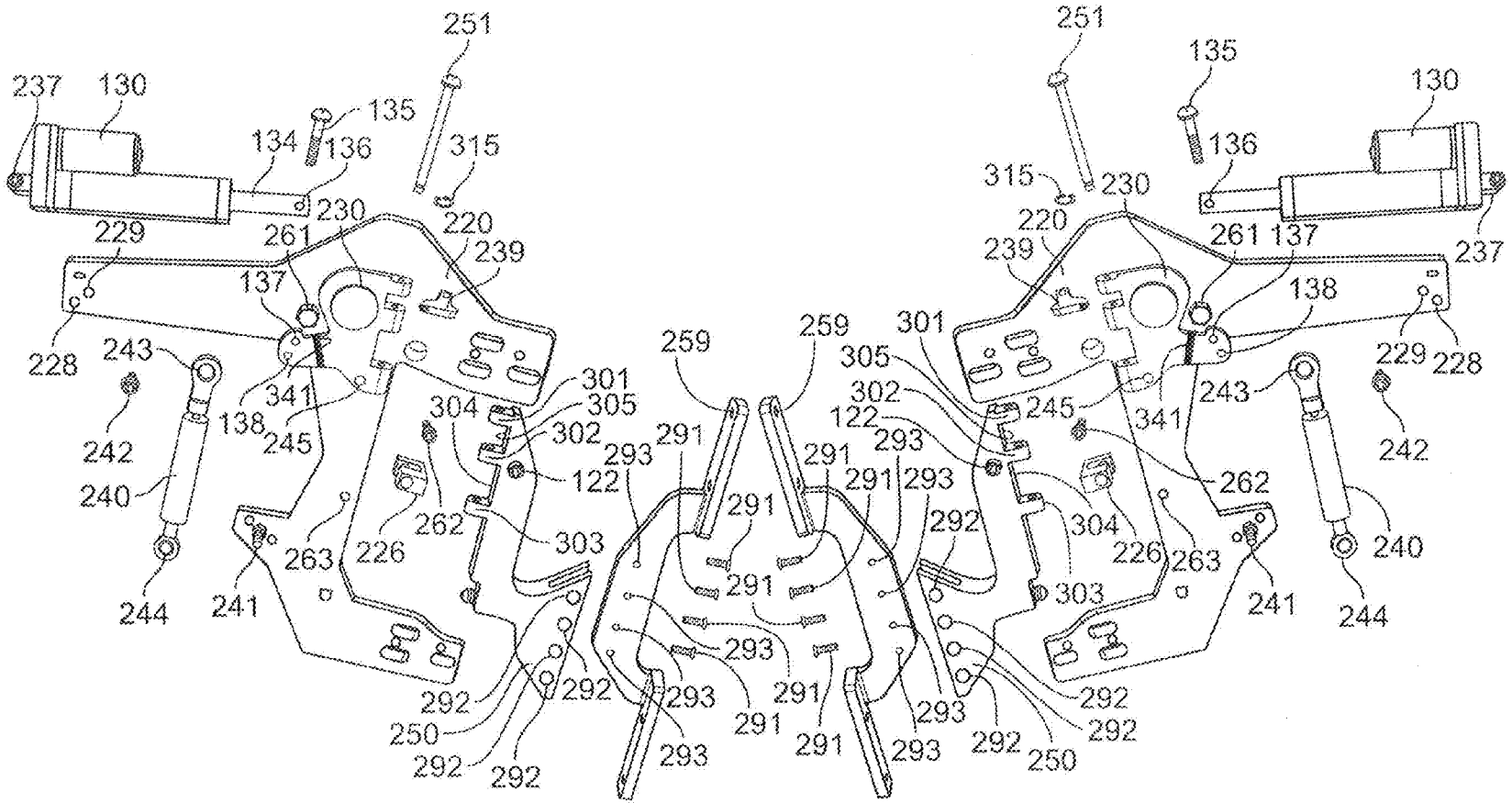
FIG. 18 is an exploded view of the hinge assembly showing both hinges, namely the left hinge and the right hinge.

In a third embodiment of the present invention, the door hinge can be made reversible. The reversibility of the door hinge is helpful in allowing a single set of hardware rather than a pair of hardware for a left and a right side. The reversibility of the vertically opening door hinge begins with a reversible base member 220. The reversible base member is made as a flat planar sheet of metal which can be cut from an automatic torch cutting machine. The reversible base member can also be cut by hand. The reversible base member has a left side and a right side. The reversible base member also has a front end and a rear end. The front end points toward the front of the car. The rear end points toward the rear of the car. The reversible base member left side is the outside face when the reversible base member is mounted on the left side of the car. The reversible base member right side is the inside face when the reversible base member is mounted on the left side of the car. The reversible base member left side is the inside face when the reversible base member is mounted on the right side of the car, and the reversible base member right side is the outside face when the reversible base member is mounted on the right side of the car. In FIG. 18, the reversible base member is shown in a mirror image showing an exploded view of both configurations, namely the left configuration and the right configuration. The left configuration can be mounted on the left side of the car, and a right configuration can be mounted on the right side of the car. The left configuration is shown on the left side of the page, and to the right configuration is shown on the right side of the page. Accordingly, the reversible base member is symmetrical along its plane so that the right side of the reversible base member looks like the mirror image of the left side of the reversible base member. Apertures are oriented at a perpendicular angle allowing symmetrical conformity. The reversible base member would not be flipped if it were removed from one side of a vehicle and installed on the other side of the vehicle. The orientation of the base member is a translation only, and does not require rotation by flipping its face.

Components mounted to the reversible base member are reversible by translation, or by mirror image flipping. Some of the components are translated, and some of the components are flipped. The ball bolt top 122 for example is removed from the reversible arm 250, flipped 180°, and then inserted into the opposite side of the reversible arm 250. On the other hand, items such as the reversible swivel member are translated to the other side without the 180° flip. The ball bolt top 122 has a right-handed screw interface with the reversible arm. Right-handed screw thread disposed on the reversible arm interacts with the ball bolt top. The right-handed screw thread is engaged in a clockwise fashion from the standpoint of an assembly person when the right-handed ball bolt top is inserted into the reversible arm. However, from the standpoint of the reversible arm, the right-handed screw thread receives rotation of the ball bolt top in opposite orientation which is reversed upon reversal of the reversible arm.

The motor 130 has input wires 131 that are connected to the wire harness 289. The wire harness has a wire harness switch 288 that gives electrical actuation to the motor. The motor is selectively mounted to the reversible base member at either an outside motor mounting opening 228 or an inside motor mounting opening 229. The inside motor mounting opening and the outside motor mounting opening have a small distance between them allowing user selection for fine-tuning and adjustment. The motor mounting aperture 237 is disposed as an opening on the motor housing, or frame attached to the motor. The motor mounting aperture 237 is mounted to the outside motor mounting opening or the inside motor mounting opening. The other end of the motor is the piston extension 134 which extends away from the motor. The piston extension has a piston extension aperture 136 at an end of the piston. The piston extension aperture 136 receives a piston extension bolt 135 which attaches it to either the swivel member first motor mounting 137 or the swivel member second motor mounting 138. The swivel member first motor mounting and the swivel member second motor mounting can both be made as threaded apertures capable of receiving the piston extension bolt. The motor 130 therefore can be reversed in translation without flipping by mounting to the other side of the reversible base member 220. Components including the piston extension bolt 135 and the bolt attaching the motor mounting aperture to the inside or outside motor mounting opening are flipped 180° and inserted in an opposite end of the respective apertures. While it is preferred that the motor housing is symmetrical, it is not absolutely required that that be the case.

The reversible swivel member 230 can also be removed an attached to either the left or right side of the reversible base member. The reversible swivel member 230 has a base stopper adjustment aperture 341 for a base stopper adjustment member that fits in the base stopper adjustment aperture. The base stopper adjustment member can be threaded and engaged with the base stopper adjustment aperture so that the base stopper adjustment member has an adjustable contact with the reversible base stopper 261. The reversible base stopper 261 is preferably formed as a bolt having a cylindrical or hexagonal top for receiving abutment against the base stopper adjustment member. The adjustment of the base stopper adjustment member selectively adjusts the stopping angle of the reversible swivel member when the car door is in a closed position. If the card or is not closing all the way, the base stopper adjustment member is preferably rotated counter clockwise relative to the reversible base stopper 261 so that the car door can close entirely.

Additionally, the reversible swivel member 230 has a reversible swivel member piston mount aperture 245 that can also be threaded in right-handed orientation so that it may receive a reversible shock piston upper mount 242 formed as a bolt that passes through a shock piston extension aperture 243 on the shock piston 240. Also, the shock piston mounting aperture 244 can be mounted on a reversible shock piston lower mount 241 formed as a bolt threaded and secured to the reversible base member. The shock piston 240 has a main body portion into which the shock piston extension extends in and out of in telescopic configuration. The shock piston 240 operates the same as in previous embodiments in that it counterbalances the weight of the car door and provides smoother motion by acting as a spring force.

A stopper bolt stopper 226 stops the stopper bolt 60. The stopper bolt stopper is also reversible by flipping. The stopper bolt stopper mounting opening 263 preferably receives a bolt such as stopper bolt stopper mounting bolt 262. The stopper bolt stopper 226 preferably sandwiches the reversible base member about the stopper bolt stopper mounting opening 263.

The reversible swivel member 230 also has an engaging edge that attaches to and pivots with an engaging edge of the reversible arm 250. The engaging edge of the reversible arm preferably includes a first reversible arm finger 301, a second reversible arm finger 302, and a third reversible arm finger 303. A first reversible arm gap 305 is formed between the first reversible arm finger 301 and the second reversible arm finger 302. A second reversible arm gap 304 is formed between the second reversible arm finger 302 and the third reversible arm finger 303. The engaging edge of the reversible swivel member preferably includes a first swivel member finger 306 and a second swivel member finger 308 forming a first swivel member gap 307 between them. The engaging edge of the reversible swivel member also preferably includes a third swivel member finger 310 and a second swivel member finger 308 forming a second swivel member gap 309 between them. The third swivel member finger 310 meets an outside edge of the first reversible arm finger 301. The first reversible arm finger 301 fits in the second swivel member gap 309. The second swivel member finger 308 fits in the first reversible arm gap 305. The second reversible arm finger 302 fits in the first swivel member gap 307 along with the toggle stopper 239. The first swivel member finger 306 fits in the second reversible arm gap 304. The third reversible arm finger 303 preferably abuts an outside edge of the first swivel member finger 306.

A reversible swivel member swivel bolt 251 extends through the first reversible arm finger 301, the second reversible arm finger 302, and the third reversible arm finger 303. The reversible swivel member swivel bolt also extends through the first swivel member finger 306, the second swivel member finger 308, and the third swivel member finger 310. An adjustable clip 315 such as the circlip shown can releasably lock to a circumferential groove at an end of the reversible swivel member swivel bolt 251. Additionally, the toggle stopper 239 may further include a toggle adjustment screw 238 that can be adjusted and screwed in for decreasing the maximum angle of the reversible arm 250 relative to the reversible swivel member 230. Accordingly, the toggle adjustment screw 238 can be adjustably screwed out a little for increasing the maximum angle of the reversible arm 250 relative to the reversible swivel member 230.

The intermediate bolting slot 321 on the reversible base member can be used for connection with car frame or other components.

The reversible arm 250 has a slot facing the car door. The slot receives a branch member 252. Reversible arm securing screw apertures 292 disposed on the reversible arm 250 receive reversible arm securing screws 291 that pass through the reversible arm securing screw apertures 292 and also through the reversible branch member securing apertures 293. In this way, the reversible arm clamps to the branch member. Four bolts or screws can be used for securing the branch member to the reversible arm. The reversible bolt opening slots 259 engage with the car door in a reversible fashion so that they can engage with the left or right car door.

The upper reversible Riser 295 and the lower reversible Riser 294 can be removed and translated to the opposite side of the reversible base member 220. The lower reversible riser includes lower reversible riser openings 296 for securing to a lower portion of the reversible base member and the upper reversible riser includes upper reversible riser openings 297 for securing to an upper portion of the reversible base member.

The reversible door hinge has a left orientation configuration and a right orientation configuration depending upon the manner of the build.

Thus, although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. A reversible door hinge comprising:

a. a reversible base member adapted to be mounted to a left side or a right side of a vehicle body, made of a flat piece of metal defining a plane, and having a left face and a right face, wherein the reversible base member is symmetric about its plane so that the left face is a mirror image of the right face, wherein the reversible door hinge has a left orientation configuration and a right orientation configuration;

b. a primary swivel member which is swivelly mounted to a first side of the base member so that the primary swivel member swivels on the plane defined by the base member, and wherein the primary swivel member has a primary swivel axis normal to the plane defined by the base member, wherein the primary swivel member is reversible for mounting on a second side of the reversible base member when the reversible door hinge is reversed in orientation;

c. an arm extended from the primary swivel member and adapted to be mounted to a left-side door or a right-side door of a vehicle, wherein the arm is swivelly mounted to the primary swivel member at a secondary swivel, wherein the secondary swivel has a secondary swivel axis of rotation normal to the primary swivel axis, wherein the arm has an extended position and a retracted position, wherein the arm extends to open the door and retracts to close the door;

d. a shock bracket mounted to the primary swivel member;

e. wherein the shock bracket has a shock bracket axis of rotation parallel to the primary swivel axis; and f. a shock mounted between the shock bracket and the base member, wherein simultaneous coplanar motion of the primary swivel member, the base member and the shock allow the shock to move on the plane of the primary swivel member and the base member, wherein the shock has a shock base end.

2. The reversible door hinge of claim 1, further comprising a motor in mechanical connection to primary swivel member, wherein the motor drives the primary swivel member and in turn the arm between the extended position and the retracted position.

3. The reversible door hinge of claim 1, wherein the arm further comprises a detachable branch member that is releaseably secured to the arm.

4. The reversible door hinge of claim 1, wherein the shock is loaded to about between 40% and 75% of travel distance.

5. The reversible door hinge of claim 1, wherein the primary swivel member further comprises a shock protrusion, wherein the shock bracket is mounted to the shock protrusion of the primary swivel member, wherein a shock bracket bolt is mounted to the shock protrusion of the primary swivel member, and wherein the shock bracket further comprises a first face parallel to a shock protrusion face, and wherein the shock bracket further comprises a second face which faces the shock, wherein the shock is secured to the second face.

6. The reversible door hinge of claim 1, further comprising: a banjo shaped receiver disposed on the shock base end, wherein the banjo shaped receiver receives a base member bolt securing the shock base end in pivotal connection to the base member.

7. The reversible door hinge of claim 1, further comprising: a pair of bolt openings, namely a primary base member bolt opening disposed on the base member, and a secondary base member bolt opening disposed on the base member adjacent to the primary base member bolt opening, wherein the pair of bolt openings allow mounting of the reversible door hinge.

8. The reversible door hinge of claim 1, further comprising: a stopper bracket formed on the base member and having a vertical face facing a stopper bolt disposed on the arm, and further comprising a ball tip mounted in the tip of the stopper bolt, wherein the ball tip rolls on the vertical face of the stopper bracket when the arm returns to the retracted position, wherein the stopper bolt is threadedly secured to the arm so as to be adjustable in length.

9. The reversible door hinge of claim 8, wherein the shock is loaded to about between 40% and 75% of travel distance.

10. The reversible door hinge of claim 8, wherein the primary swivel member further comprises a shock protrusion, wherein the shock bracket is mounted to the shock protrusion of the primary swivel member, wherein a shock bracket bolt is mounted to the shock protrusion of the primary swivel member, and wherein the shock bracket further comprises a first face parallel to a shock protrusion face, and wherein the shock bracket further comprises a second face which faces the shock, wherein the shock is secured to the second face.

11. The reversible door hinge of claim 8, further comprising: a banjo shaped receiver disposed on the shock base end, wherein the banjo shaped receiver receives a base member bolt securing the shock base end in pivotal connection to the base member.

12. The reversible door hinge of claim 8, further comprising: a pair of bolt openings, namely a primary base member bolt opening disposed on the base member, and a secondary base member bolt opening disposed on the base member adjacent to the primary base member bolt opening, wherein the pair of bolt openings provides a location for mounting the reversible door hinge.

13. A reversible door hinge for a vehicle comprising:

a. a reversible base member adapted to be mounted to a left side or a right side of a vehicle body, made of a flat piece of metal defining a plane, and having a left face and a right face, wherein the reversible base member is symmetric about its plane so that the left face is a mirror image of the right face, wherein the reversible door hinge has a left orientation configuration and a right orientation configuration;

b. a primary swivel member which is swivelly mounted to a first side of the base member so that the primary swivel member swivels on the plane defined by the base member, and wherein the primary swivel member has a primary swivel axis normal to the plane defined by the base member, wherein the primary swivel member is reversible for mounting on a second side of the reversible base member when the reversible door hinge is reversed in orientation;

c. an arm extended from the primary swivel member and adapted to be mounted to a left-side door or a right-side door of a vehicle, wherein the arm is swivelly mounted to the primary swivel member at a secondary swivel, wherein the secondary swivel has a secondary swivel axis of rotation normal to the primary swivel axis, wherein the arm has an extended position and a retracted position, wherein the arm extends to open the door and retracts to close the door;

d. a shock bracket mounted to the primary swivel member;

e. wherein the shock bracket has a shock bracket axis of rotation parallel to the primary swivel axis;

f. a shock mounted between the shock bracket and the base member, wherein simultaneous coplanar motion of the primary swivel member, the base member and the shock allow the shock to move on the plane of the primary swivel member and the base member, wherein the shock has a shock base end;

g. a motor in mechanical connection to primary swivel member, wherein the motor drives the primary swivel member between the extended position and the retracted position; and h. a detachable branch member that is releaseably secured to the arm.

14. The reversible door hinge of claim 13, wherein the shock is loaded to about between 40% and 75% of travel distance.

15. The reversible door hinge of claim 14, wherein the primary swivel member further comprises a shock protrusion, wherein the shock bracket is mounted to the shock protrusion of the primary swivel member, wherein a shock bracket bolt is mounted to the shock protrusion of the primary swivel member, and wherein the shock bracket further comprises a first face parallel to a shock protrusion face, and wherein the shock bracket further comprises a second face which faces the shock, wherein the shock is secured to the second face.

16. The reversible door hinge of claim 15, further comprising: a ball bolt disposed on the arm, wherein the ball bolt opposes a ramp profile on the base member, wherein when a ball roller of the ball bolt rolls up the ramp profile the ball bolt biases the arm away from the base member when the arm is in extended position.

17. The reversible door hinge of claim 13, further comprising: a stopper bracket formed on the base member and having a vertical face facing a stopper bolt disposed on the arm, and further comprising a ball tip mounted in the tip of the stopper bolt, wherein the ball tip rolls on the vertical face of the stopper bracket when the arm returns to a retracted position, wherein the stopper bolt is threadedly secured to the arm so as to be adjustable in length.

18. A reversible door hinge for a vehicle comprising:

a. a reversible base member adapted to be mounted to a left side or a right side of a vehicle body, made of a flat piece of metal defining a plane, and having a left face and a right face, wherein the reversible base member is symmetric about its plane so that the left face is a mirror image of the right face, wherein the reversible door hinge has a left orientation configuration and a right orientation configuration;

b. a primary swivel member which is swivelly mounted to a first side of the base member so that the primary swivel member swivels on the plane defined by the base member, and wherein the primary swivel member has a primary swivel axis normal to the plane defined by the base member, wherein the primary swivel member is reversible for mounting on a second side of the reversible base member when the reversible door hinge is reversed in orientation;

c. an arm extended from the primary swivel member and adapted to be mounted to a left-side door or a right-side door of a vehicle, wherein the arm is swivelly mounted to the primary swivel member at a secondary swivel, wherein the secondary swivel has a secondary swivel axis of rotation normal to the primary swivel axis, wherein the arm has an extended position corresponding to an open vehicle door and a retracted position corresponding to a closed vehicle door, wherein the arm extends to open the door and retracts to close the door;

d. a shock bracket mounted to the primary swivel member;

e. wherein the shock bracket has a shock bracket axis of rotation parallel to the primary swivel axis;

f. a shock mounted between the shock bracket and the base member, wherein simultaneous coplanar motion of the primary swivel member, the base member and the shock allow the shock to move on the plane of the primary swivel member and the base member, wherein the shock has a shock base end;

g. a motor in mechanical connection to primary swivel member, wherein the motor drives the primary swivel member between the extended position and the retracted position;

h. a detachable branch member that is releaseably secured to the arm; and i. a ball bolt disposed on the arm, wherein the ball bolt opposes a ramp profile on the base member, wherein when a ball roller of the ball bolt rolls up the ramp profile the ball bolt biases the arm away from the base member when the arm is in extended position.

19. The reversible door hinge of claim 18, wherein the primary swivel member further comprises a shock protrusion, wherein the shock bracket is mounted to the shock protrusion of the primary swivel member, wherein a shock bracket bolt is mounted to the shock protrusion of the primary swivel member, and wherein the shock bracket further comprises a first face parallel to a shock protrusion face, and wherein the shock bracket further comprises a second face which faces the shock, wherein the shock is secured to the second face.

20. The reversible door hinge of claim 18, further comprising: a banjo shaped receiver disposed on the shock base end, wherein the banjo shaped receiver receives a base member bolt securing the shock base end in pivotal connection to the base member; and a pair of bolt openings, namely a primary base member bolt opening disposed on the base member, and a secondary base member bolt opening disposed on the base member adjacent to the primary base member bolt opening, wherein the pair of bolt openings provides a location for mounting the reversible door hinge.

* * * * *